US005528278A

United States Patent [19]

Takizawa et al.

[11] Patent Number: 5,528,278

[45] Date of Patent: Jun. 18, 1996

[54] VIDEO PRINTER HAVING REWIND FUNCTION TO IMPROVE TRANSFER SHEET UTILIZATION

[75] Inventors: Naoki Takizawa; Yasushi Hirumi; Koji Yoshino; Koichi Kokusho; Masakazu Sone; Kozo Kawakita; Hidehiko Funayama, all of Kanagawa, Japan

[73] Assignee: Sony Corporation, Tokyo, Japan

[21] Appl. No.: 981,208

[22] Filed: Nov. 25, 1992

[30] Foreign Application Priority Data

| | | | |
|---|---|---|---|
| Nov. 28, 1991 | [JP] | Japan | 3-314259 |
| Nov. 28, 1991 | [JP] | Japan | 3-314260 |
| Nov. 30, 1991 | [JP] | Japan | 3-342076 |
| Nov. 30, 1991 | [JP] | Japan | 3-342077 |
| Nov. 30, 1991 | [JP] | Japan | 3-342078 |

[51] Int. Cl.[6] ..... B41J 11/42

[52] U.S. Cl. ..... 347/218

[58] Field of Search ..... 346/76 PH, 134, 346/136, 24; 347/218; 400/612, 621

[56] References Cited

U.S. PATENT DOCUMENTS 5,230,576 7/1993 Sone ..... 400/649

*Primary Examiner*—Huan H. Tran

*Attorney, Agent, or Firm*—Ronald P. Kananen

[57] ABSTRACT

A video printer includes a chassis, a platen rotatably mounted on the chassis, a printing head carried by the chassis so as to be moved between a pressure-contact position in which the printing head is pressure-contacted with the platen and a standby position in which the printing head is spaced apart from the platen, a roll for pressure-contacting a transfer sheet against the platen, and a cutter provided at a position spaced apart from the printing head and proximate to the sheet exit opening. The transfer sheet is provided in a sheet guide system through a space between the platen and the printing head as far as a sheet exit opening. The printing head is moved to the pressure-contact position during printing time and to the standby position during non-printing time. When printing an image on the transfer sheet, the transfer sheet is rewound by a distance less than a distance between the printing head and the cutter for effective utilization of the transfer sheet.

9 Claims, 25 Drawing Sheets

VIDEO PRINTER HAVING REWIND FUNCTION TO IMPROVE TRANSFER SHEET UTILIZATION

BACKGROUND OF THE INVENTION

1. Field of the Invention

This invention relates to a video printer for transforming video signals into an image and printing the transformed image on a transfer sheet.

2. Description of the Prior Art

The conventional video printer, as it is so-called, is mainly comprised of an image memory for fixedly holding an image during a recording operation, a gradation control section, a transfer unit for transferring a transfer sheet etc. and a recording medium. In distinction from a printer other than the video printer mainly aimed at drawing an ordinary letter or a delineating a drawing, the video printer features analog expression of the gradation because the image recorded is a natural image.

The video printer is classified into, for example, an ink jet system printer, a thermal transfer type printer and a silver halide type printer. With the thermal transfer type printer, for example, a transfer sheet comprised of an imaging sheet and a base film coated with ink is pressed between a printing drum and a thermal head and an electric energy applied to the thermal head during rotation of the printing drum is controlled depending on the amplitude of the image signals for expression of the gradation. A line head is frequently employed as the thermal head because of ease in pixel positioning and recording time reduction. Video signals are supplied to such video printer from e.g. a video camera.

Usually, a roll-shaped heat-sensitive sheet is employed as the transfer sheet in the above-mentioned thermal transfer type video printer.

Meanwhile, in the above-described conventional video printer, the transfer sheets 120 (roll sheets 122) are cut by a cutter 133 provided at a rectangular opening of a video printer casing (operating panel), as shown in FIG. 1.

Besides, with the video printer, the distance C between the cutter 133 and a heater 131 of a thermal head 130, for example, cannot be reduced to zero, because of mechanical constraints.

Thus, when the transfer sheet 120 having the image printed thereon is severed by outer 133, a margin corresponding to the distance between the severing position by the cutter 133 and the printing start position by the thermal head 130 or heater 131, that is the margin corresponding to the distance C, is necessarily produced in the printed transfer sheet 120. That is, the amount a of the margin between a portion 121 of the transfer sheet 120 having the image printed thereon and the severed position amounts to, for example, 20 to 30 mm.

Consequently, the number of sheets of the roll-shaped transfer sheet 120 (roll sheets 122) that can be printed by each roll is diminished because of the presence of the margin. Meanwhile, this number is on the order of e.g. 205 per 20 m-long transfer sheet roll, in the case of a conventional video printer.

Besides, in the above-described conventional video printer, the transfer sheet 120 (roll sheet 122) is severed by the cutter 133 provided at the rectangular opening provided on the front surface of the video printer casing, that is the opening in the operating panel, as shown in FIG. 3.

On the other hand, it is not possible with the video printer to reduce the distance C between the position of the cutter 133 and the heater 131 of the thermal head 130 to zero because of mechanical constraints.

Thus, when the transfer sheet 120 having the image printed thereon is severed by cuter 133, a margin corresponding to the distance between the severing position by the cutter 133 and the printing start position by the thermal head 130 or heater 131, that is the margin corresponding to the distance C, is necessarily produced in the printed transfer sheet 120.

In other words, if plural images are to be printed on the transfer sheet 120, the severing margin is necessarily provided between neighboring image printing units on the transfer sheet 120 (between neighboring image portions).

Consequently, the number of sheets of the roll-shaped transfer sheet 120 (roll sheets 122) that can be printed by each roll is diminished because of the presence of the margin. Meanwhile, this number is on the order of e.g. 230 per 20 m-long transfer sheet roll, in the case of a conventional video printer.

Besides, when printing an image on a transfer sheet by the above-described video printer, a print mode is selected from a variety of modes indicating a variety of functions of the video printer, and a print start key, provided on an operating panel of the video printer, is turned on to carry out the printing.

In addition, with the above-described video printer, video data stored in and read out from the image memory to enable plural printed sheets to be made from the same image. When making plural printed sheets of the same image, it is necessary to specify the number of sheets to be printed after selection of the print mode.

Thus, if, with the above-described conventional video printer, it is desired to obtain plural printed sheets from an image stored in the image memory, or if the number of sheets to be printed was set in an incorrect manner, it is necessary to repeat the operations of selecting the print mode, specifying the number of sheets to be printed and turning on the print start key, which means a troublesome and time-consuming operation.

Besides, with a majority of conventional video printers, the contents of the operating mode or the number of sheets to be printed etc. may be confirmed by display means, such as a liquid crystal display.

However, it is desirable to reduce the size of the video printer in view of ease in transportation and the spatial utilization efficiency, such that provision of the display means, such as $LCD_5$, is unfavorable from the standpoint of size reduction.

OBJECTS AND SUMMARY OF THE INVENTION

It is therefore an object of the present invention to provide a video printer whereby the number of sheets that may be printed per transfer paper roll may be increased.

It is another object of the present invention to provide a video printer which is small in size and which enabled facilitated printing.

The present invention provides a video printer comprising a head for printing an image based on video signals on a transfer sheet and a cutter provided aloof from the head for cutting the transfer sheet, in which, when the image is to be printed on the transfer sheet, the transfer sheet is rewound by an amount less than a distance between the head and the cutter before proceeding to printing.

That is, the present invention provides a video printer employing a roll-shaped transfer sheet, in which if a feed quantity for assuring a margin for severing printed results is larger than a feed quantity for assuring a demarcation between printed sheet portions, the transfer sheet is rewound after feeding the sheet for providing the margin for severing and immediately before next printing to reduce consumption of the transfer sheet roll, that is to increase the number of times of printing feasible with a transfer roll.

In the video printer of the present invention, image printing on the transfer sheet is performed after rewinding the sheet for reducing the margin. The transfer sheet is rewound by an amount less than the distance between the head and the cutter for assuring normal printing without the transfer sheet from being disengaged from the head. That is, when printing an image on the transfer sheet with the video printer of the present invention, the transfer sheet is rewound by an amount less than the distance between the head and the cutter for increasing the number of times of printing per transfer roll.

The present invention also provides a video printer comprising a head for printing an image based on video signals on a transfer sheet and a cutter provided aloof from the head for cutting the transfer sheet, characterized by changeover means for changing over the feed quantity of the transfer sheet between the printing units or margin in plural stages when printing plural images on said transfer sheet, and controlling means for controlling the feed quantity of the transfer sheet between the printing units responsive to the changeover signals from this changeover means.

In sum, the present invention provides a video printer of the type in which a roll-shaped transfer sheet is employed and a margin is provided in each printing unit, wherein, according to the present invention, the margin is provided with plural stages of constants, such as by setting a suitable length of the margin for severing the sheet, or by setting the margin so as to be equal to a minimum necessary length to permit discrimination between the neighboring margins, and these constants having plural stages are controllable from outside by changeover means which are controlled by software methodology whereby the consumption of the transfer sheet per each printing result may be diminished. Other objects and advantages of the present invention will become clear from the following description of preferred embodiments and accompanying claims.

DETAILED DESCRIPTION OF THE PREFERRED EMBODIMENT

Figure 4:
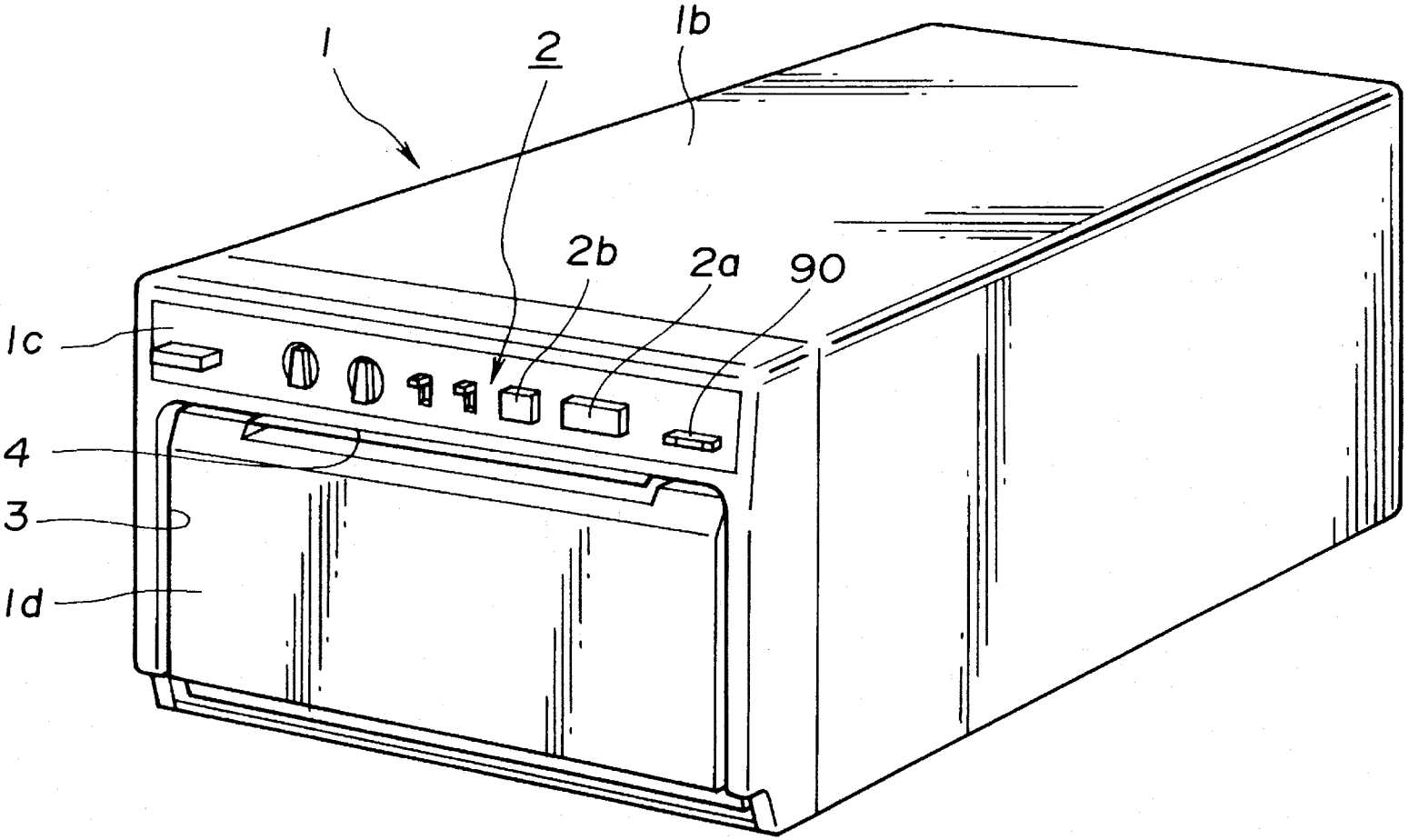
FIG. 4 is a perspective view of a printer shown with a sheet housing section in a closed position.
Figure 5:
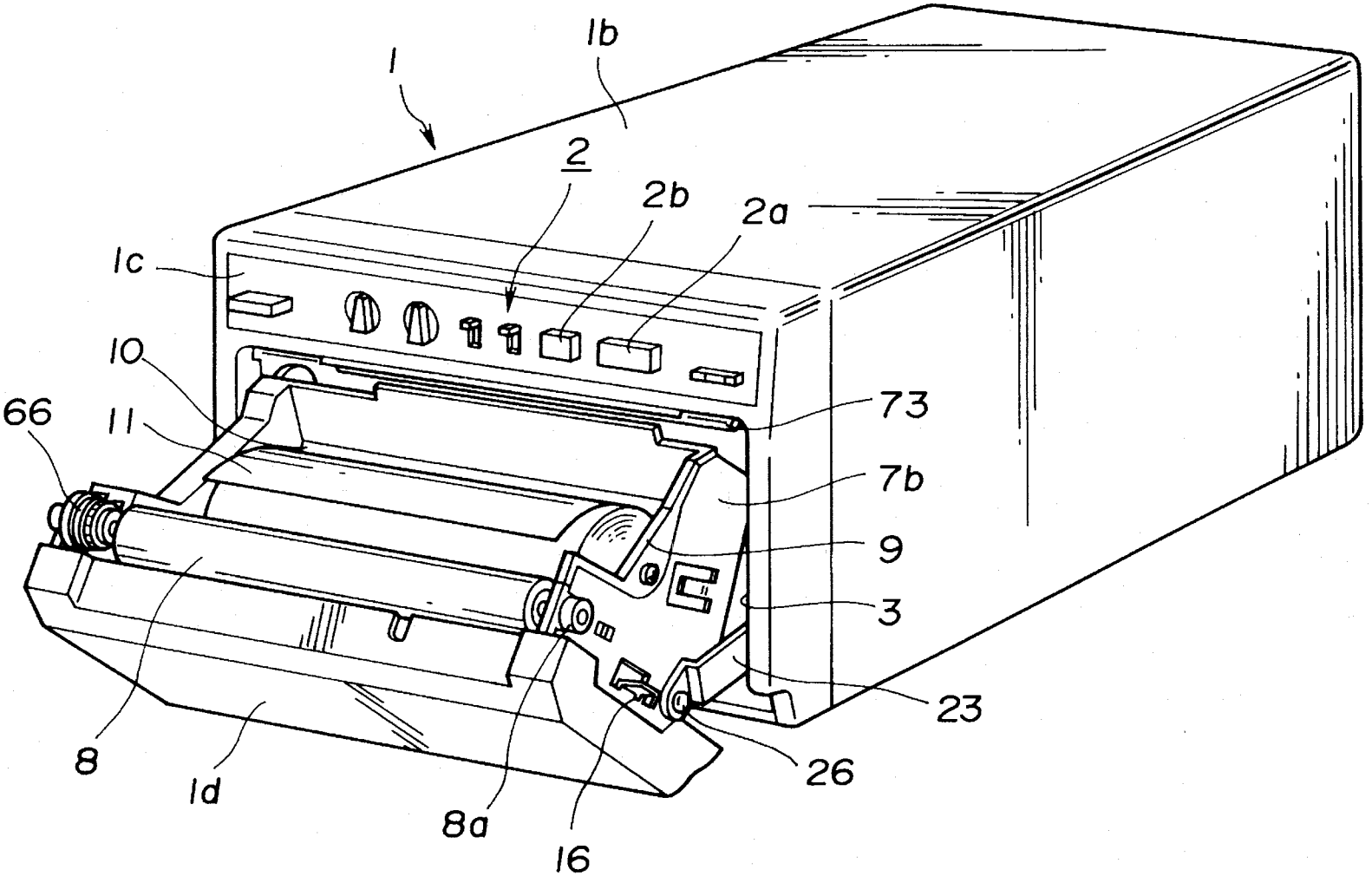
FIG. 5 is a perspective view of a printer shown with the sheet housing section in an open position.
Figure 6:
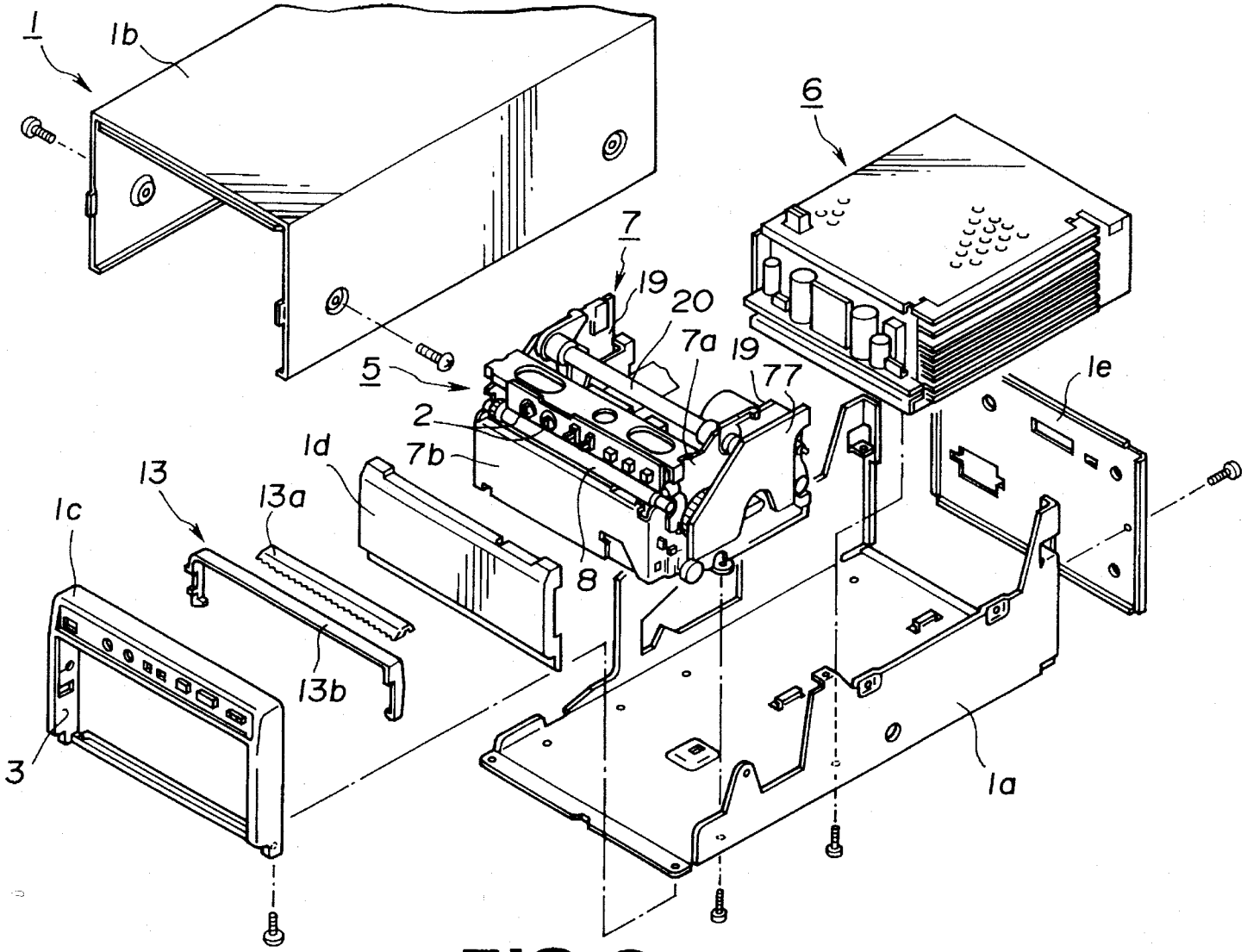
FIG. 6 is an exploded perspective view showing a printer.

The video printer according to the present invention includes a casing 1 for housing a main body of the video printer, as shown in FIGS. 4 and 5. The casing 1 is formed of synthetic resin and is made up of a bottom cover 1*a* closing its lower surface, a top cover 1*b* closing its upper and both lateral sides, a door panel 1*d* and a rear panel 1*e* closing its rear side, as shown in FIG. 6. Operating switches 2, such as a print key, are arrayed on a top side of the operating panel 1c, and a larger aperture 3 is provided below the operating switches 2.

Figure 14:
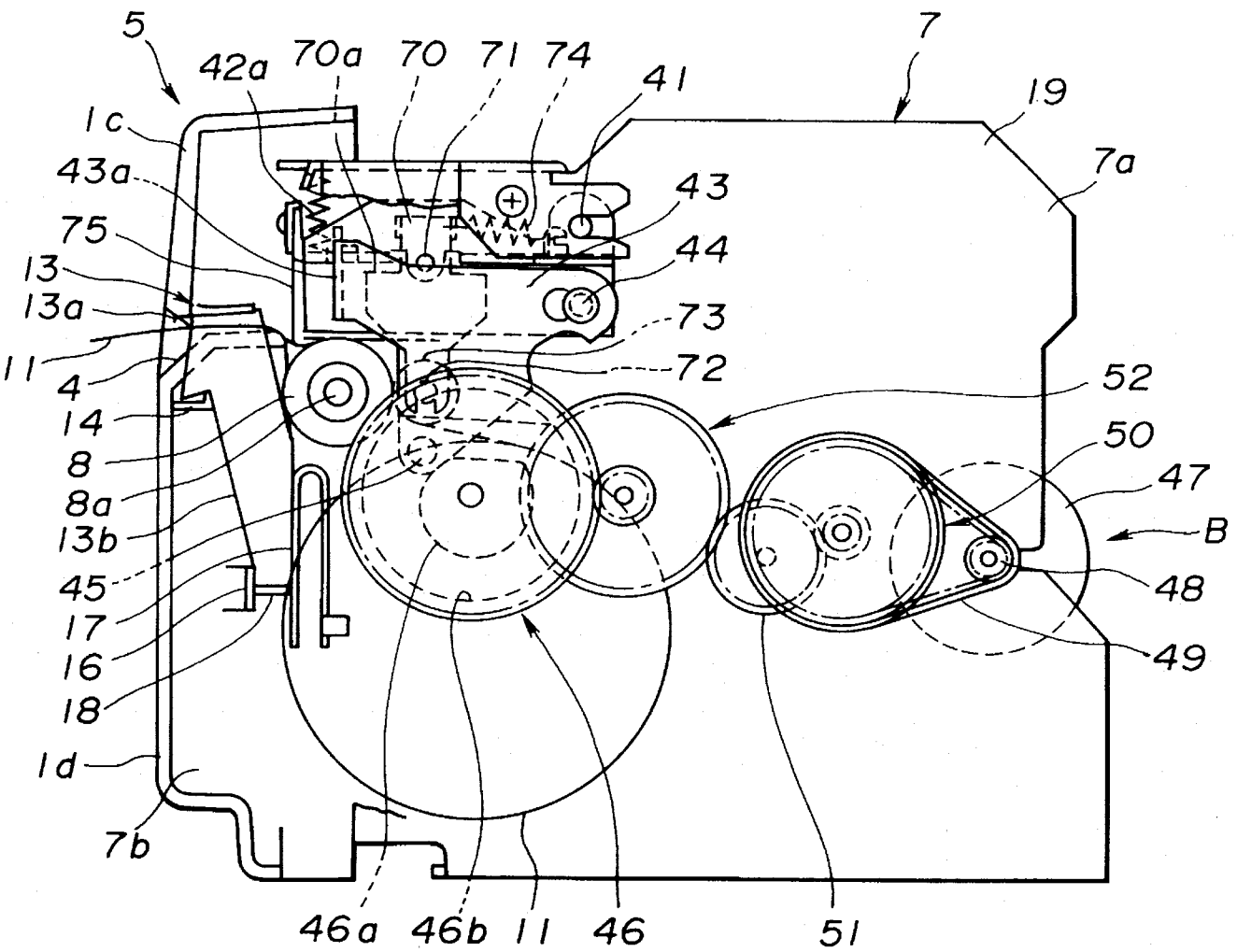
FIG. 14 is a right-hand side view mainly showing a head lift mechanism, shown with a thermal head in a pressure contact position.

The door panel 1d is provided within the aperture 3 when the sheet housing section 10 is in the closed position, with an upper portion of the aperture 3 not closed by the door panel 1d constituting a sheet discharge section 4, as shown in FIG. 14. A sub-chassis 7b to be later explained is extracted via the aperture 3 when the sheet housing section 10 is in the open position, as shown in FIG. 5.

A mechanical block 5 secured to a chassis 7 and a substrate block 6 are housed towards the front and rear sides within the casing, respectively.

Figure 8:
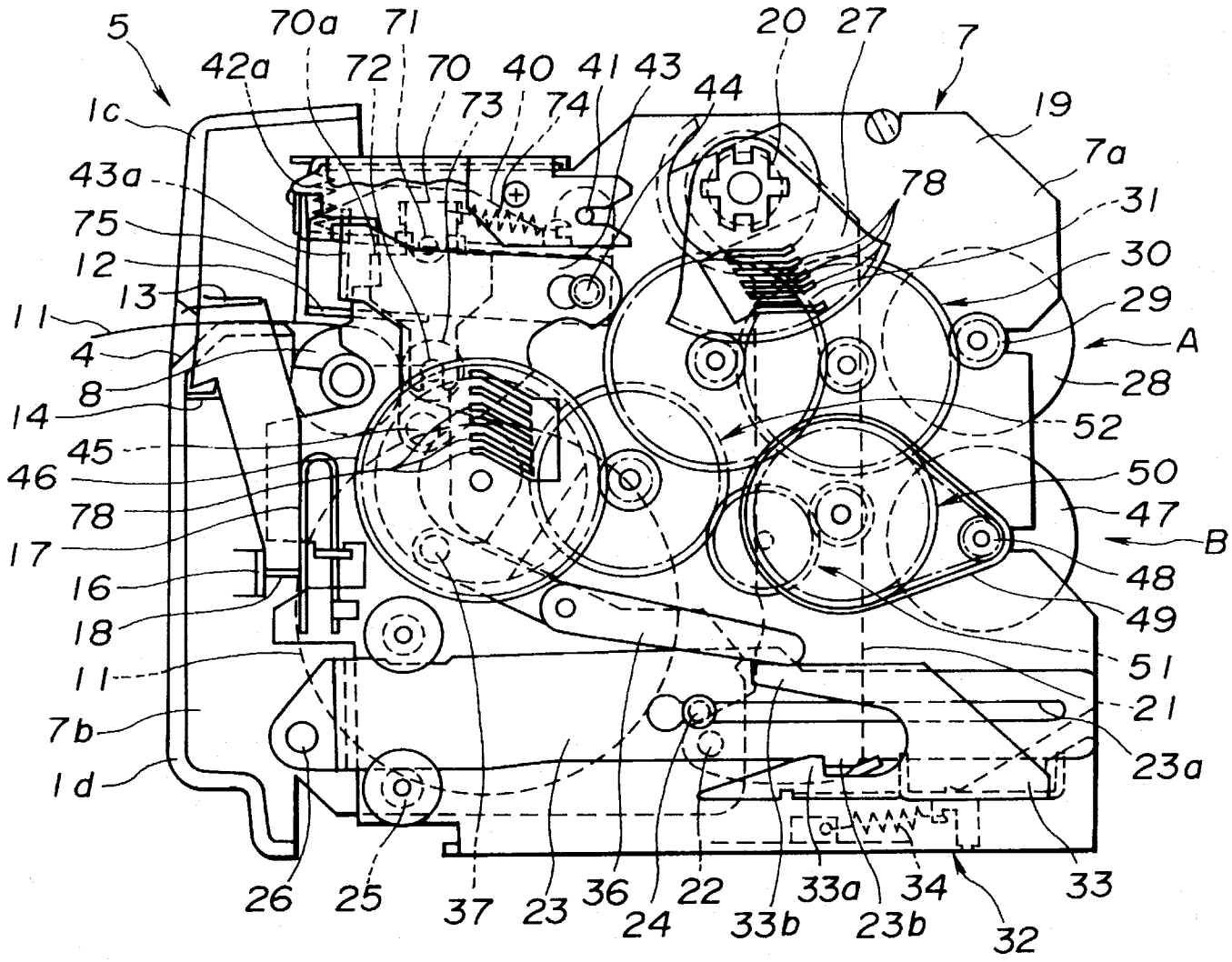
FIG. 8 is a right-hand side view showing a chassis block member with the sheet housing section in a closed position.
Figure 9:
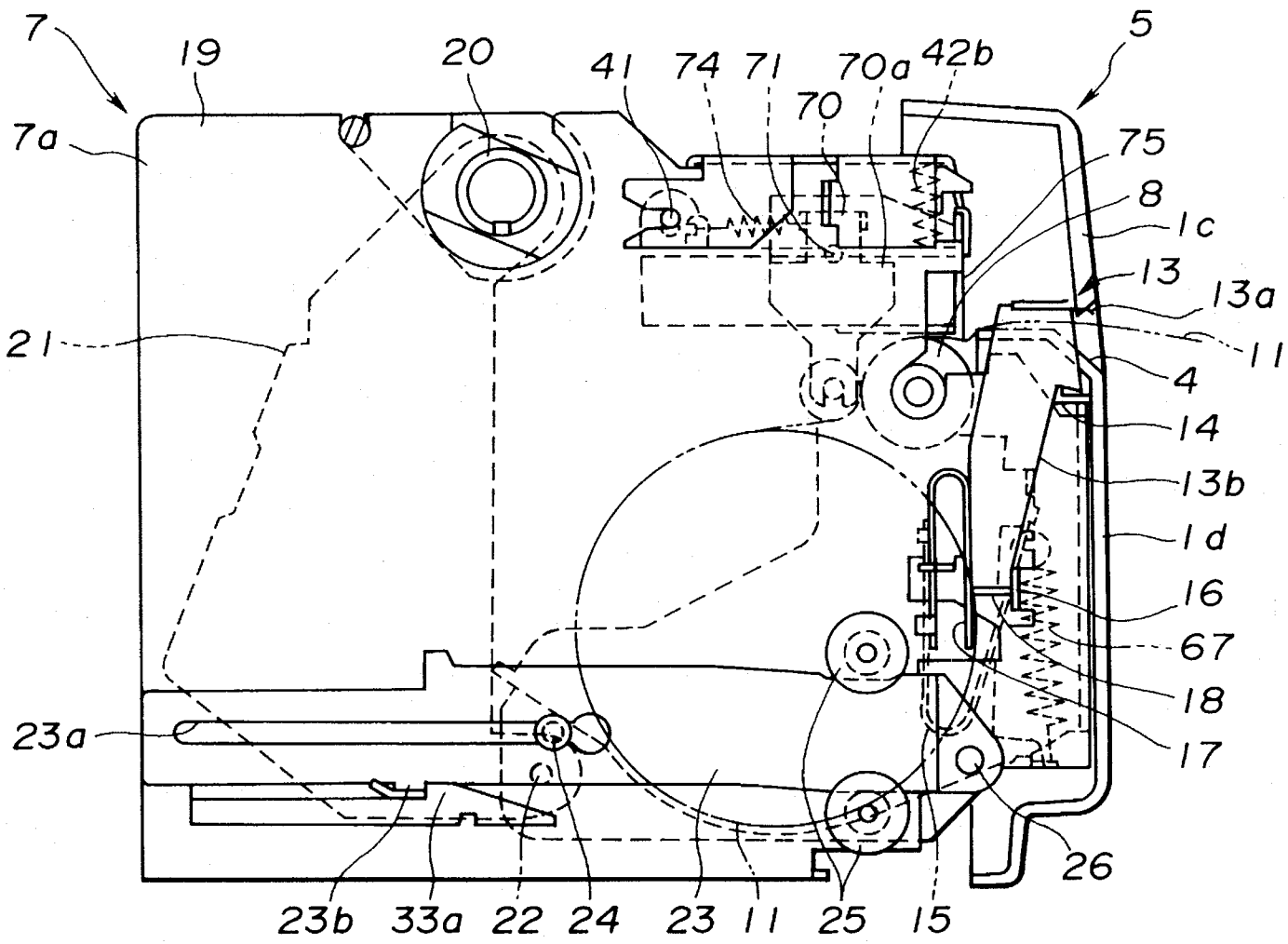
FIG. 9 is a left-hand side view showing a chassis block member with the sheet housing section in a closed position.
Figure 10:
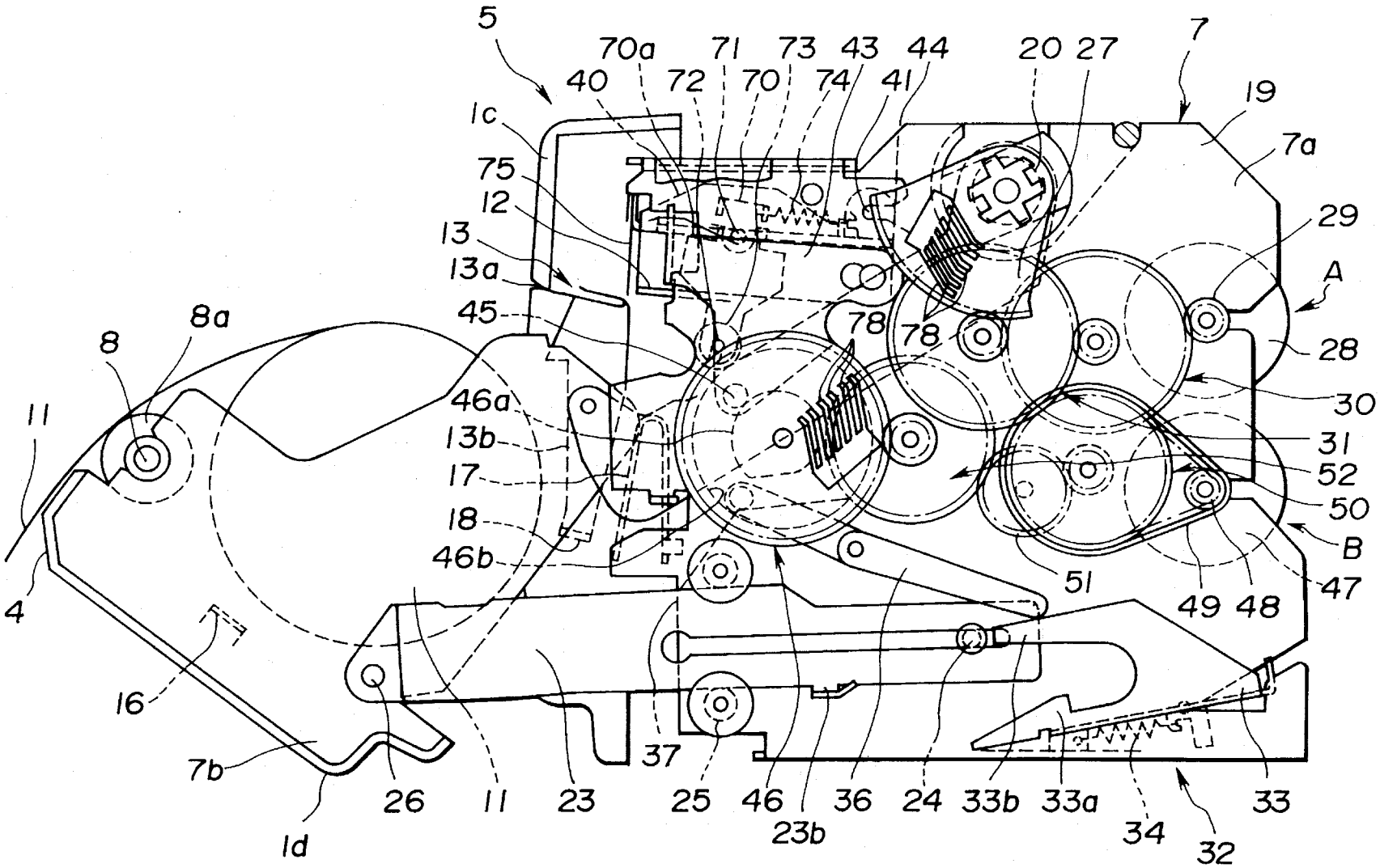
FIG. 10 is a right-hand side view showing a chassis block member with the sheet housing section in an open position.

The mechanical block 5 etc. is shown in left-hand and right-hand side views of FIGS. 8 and 9, with the sheet housing section 10 in the closed position, respectively, while the mechanical block 5 etc. is shown in a right-hand side view of FIG. 10, with the sheet housing section 10 in the open position.

Referring to FIGS. 8 and 9, the chassis 7 is made up of a main chassis 7a and the sub-chassis 7b, both formed of a metallic material, with the main chassis 7a being mounted on the bottom cover 1a. The front panel 1c and the door panel 1d are mounted on the front sides of the main chassis 7a and he sub-chassis 7b, respectively.

A platen 8, formed of rubber, is supported for rotation on an upper end of the sub-chassis 7b. Rotation of the platen 8 is by a platen rotating mechanism to be later explained. A tray 9 having an arcuate lower surface is formed within the sub-chassis 7b, with a space above the tray 9 defining the sheet housing section 10. A roll-shaped heat-sensitive transfer sheet 11 is house within the sheet housing section 10 which may be automatically opened and closed by a sheet housing section opening/closing mechanism for exchange of printing sheets, in a manner which will be explained subsequently. The foremost part of the printing sheet 11 is passed through a space between platen 8 and roll 73 and a space between platen 8 and thermal head 12 so as to be placed in a sheet feed passage reaching the sheet discharge opening 4.

The thermal head 12 is supported at the upper end of the main chassis 7a and adapted to be moved by a head lift unit.

The cutter 13 is formed of a metallic material and made up of a blade 13a and a blade mounting section 13b supporting the blade 13. The blade mounting section 13b is oscillatably mounted at a hook 14 of front panel 1c and the cutter 13 is provided for being moved between a projected position shown in FIG. 8 and a receded position shown in FIG. 10. The cutter 13 is biased by a first torsion spring 15 shown in FIG. 9 towards the receded position. A cutter thrusting section 16 is provided on the sub-chassis 7b, and a second torsion spring 17 has its one end supported by the main chassis 7a. The cutter thrusting section 18 thrusts one end of a thrust section 18 at the closed position of the sheet housing section 10, while the other end of the thrust section 16 is acted upon by the second torsion spring 17, for maintaining the cutter 13 at the projected position against the bias of the first torsion spring 17. The cutter 13 is grounded to the main chassis 7a by the first torsion spring 17 to prevent electrostatic noises. When the sheet housing section 10 is moved from its closed position to its open position, the cuter thrusting section 16 is moved away from the thrust section 18 for receding the cutter 13 to its receded position under the bias of the first torsion coil spring 15.

A photosensor, not shown, made up of a light emitter and a light receiver, is provided between the cutter 13 and the thermal head 12 for detecting the possible presence of the transfer sheet 11. If there is the transfer sheet 11 between the cuter 13 and the thermal head 12, the light from the light emitter is shut off by the transfer sheet 11 and hence cannot reach the receiver to permit detection of the transfer sheet 11. Conversely, if the light from light emitter can be received by the receiver, it can be concluded that there is no transfer sheet 11 between the cutter 13 and the thermal head 12.

Figure 11:
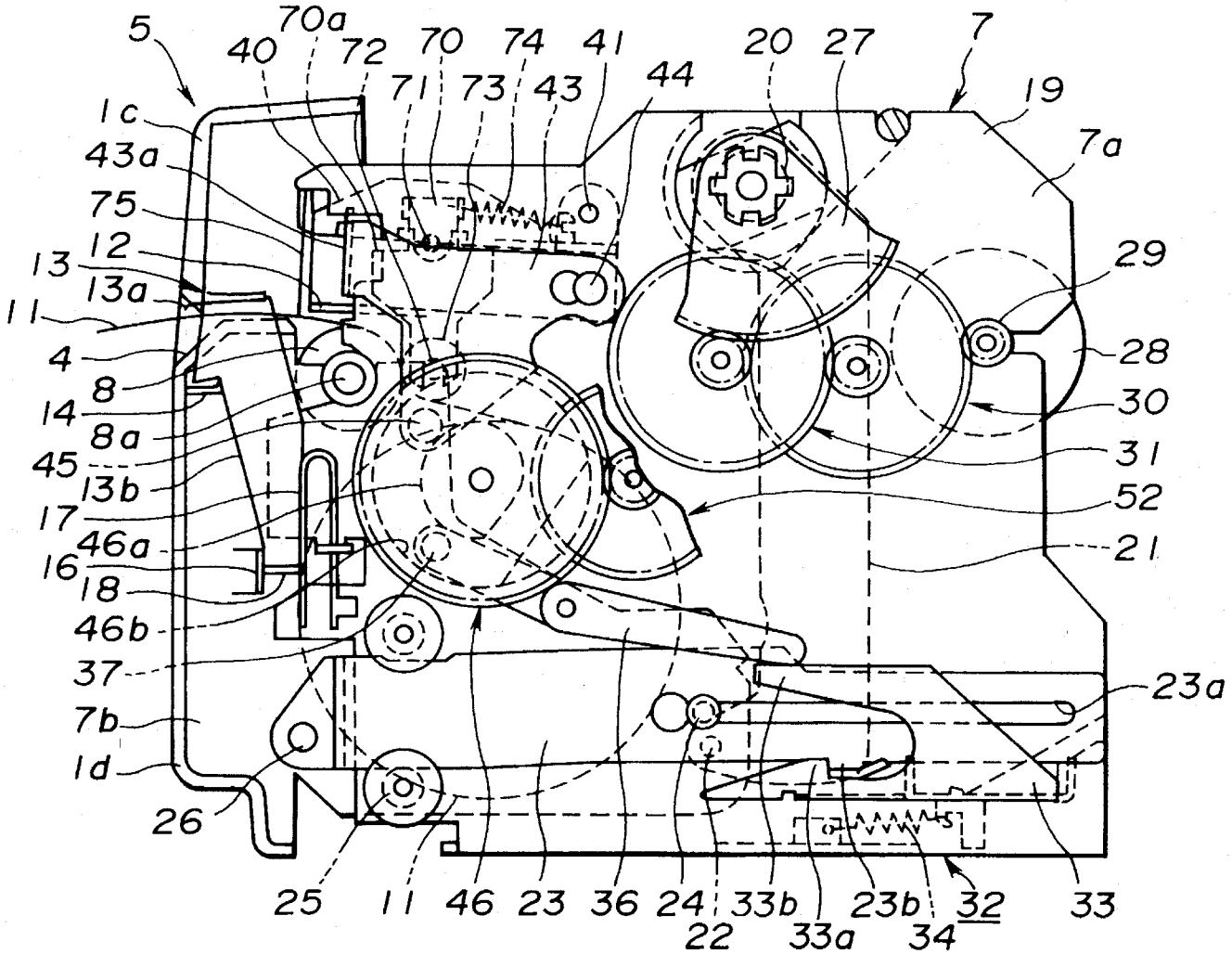
FIG. 11 is a right-hand side view mainly showing a sheet housing section opening/closing section, shown in the locked state and with the sheet housing section in a closed position.
Figure 12:
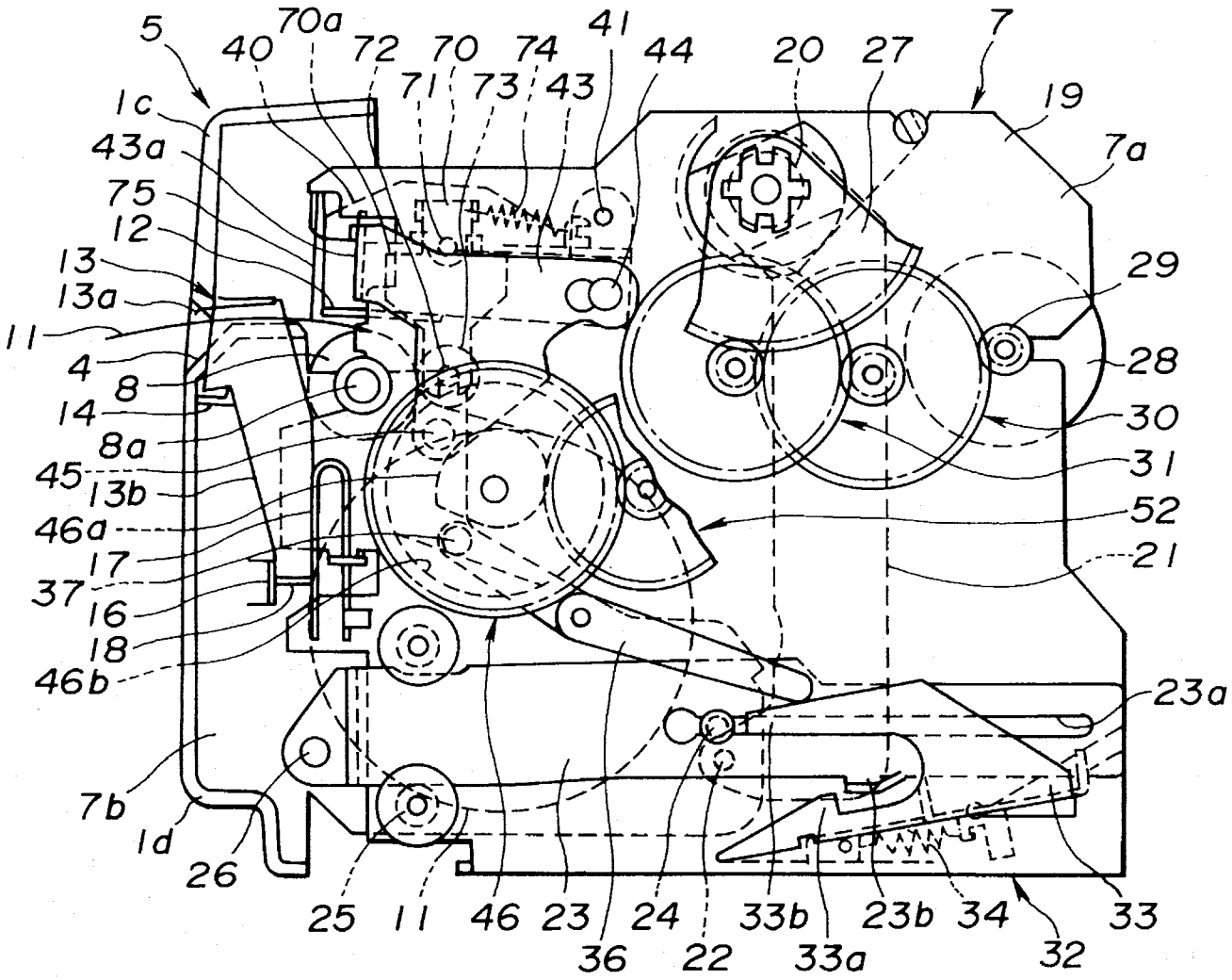
FIG. 12 is a right-hand side view mainly showing the sheet housing section opening/closing section, shown in the unlocked state and with the sheet housing section in a closed position.
Figure 13:
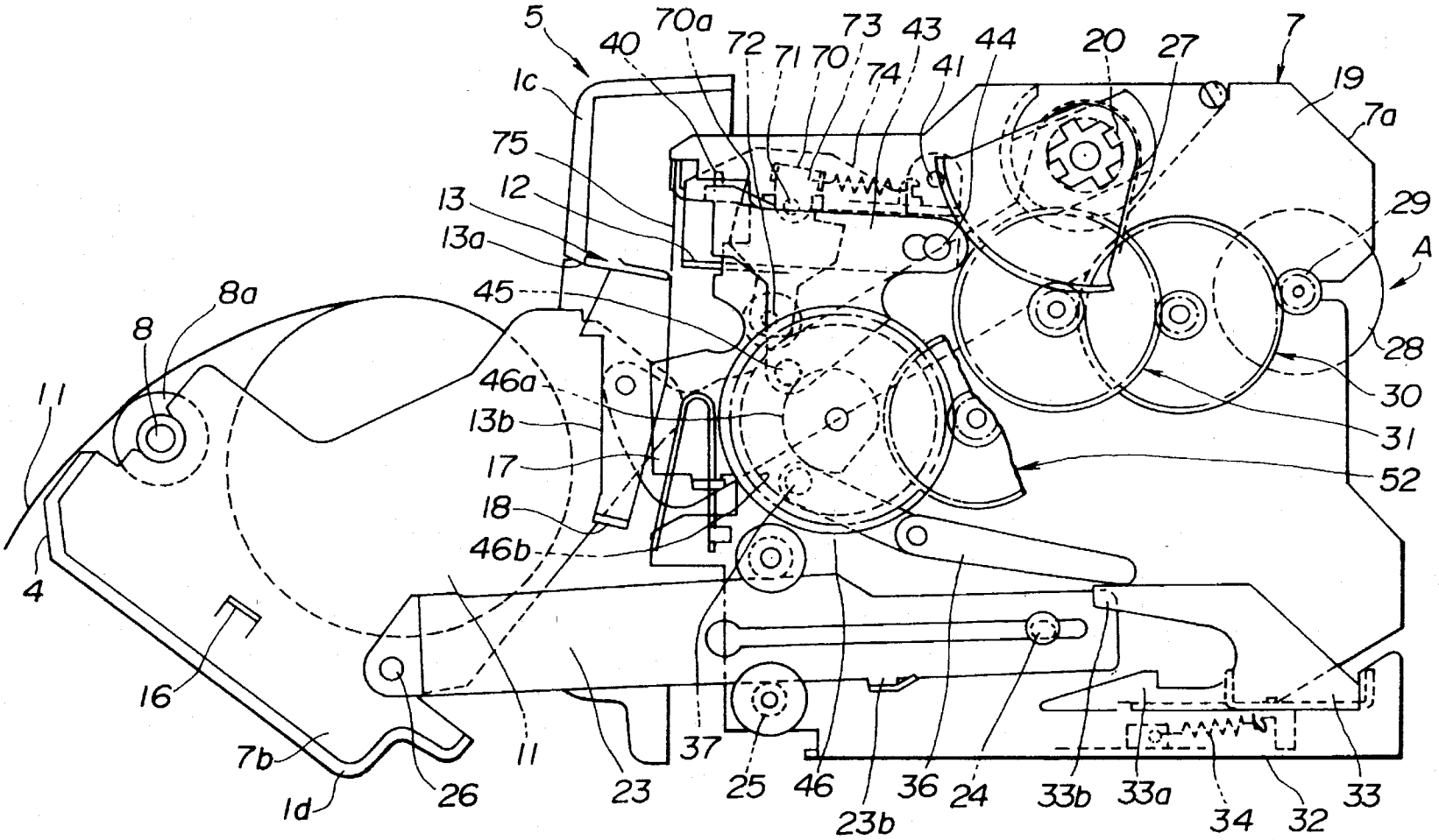
FIG. 13 a right-hand side view mainly showing the sheet housing section opening/closing section, shown with the sheet housing section in an open position.

In the right-hand side views of FIGS. 11 to 13, the sheet housing section opening/closing unit, above all, is shown. In these figures, the sheet opening/closing unit is adapted for automatically opening and closing the sheet housing section. A synchronizing shaft 20 is supported for rotation by lateral side plates 19 of the main chassis 7a, and a pair of arm members 21 are secured to both inner sides of the side plates 19 on both ends of the synchronizing shaft 20. Each of these arm members 21 has its foremost part fulcrumed at the rear end of the sub-chassis 7b.

A pair of slide members 23 are arranged outwardly of the lateral side plates 19 of the main chassis 7a and are provided with guide pins 24 protruded from both lateral side plates 19 and introduced into elongated holes 23a formed in the slide members 23. Guide rolls 25 carried by the side plates 19 are contacted with upper and lower surfaces of the slide members 23 which may be slid back and forth by the guide pins 24 and the guide rolls 25. Each of the slide members 23 has its forward end fulcrumed by a supporting pin 26 by the forward end of the sub-chassis 7b.

A sector gear 27 is secured to the right-hand side end of the synchronizing shaft 20 to which rotation of the driving motor 28 is transmitted via two speed-reducing gears 30, 31 and a gear 29 secured to a rotary shaft of the driving motor 28.

A sheet housing section locking unit 32 has a locking lever 33 oscillatably mounted on the right side plate 19 of the main chassis 7a. The locking lever 33 has a retention part 33a adapted to be moved between a locking position and an unlocking position. The locking lever 33 is acted upon by a spring 34 biasing the lever 33 towards its locking position at which the retention part 33a is retained by a mating retention part 23b of the right-hand side slide member 23. The locking lever 33 has a thrust section 33b acted upon by an end of a release lever 36 which has its mid part fulcrumed by the main chassis. A cam pin 37 is provided at the other end of the release lever 36 and is caused to bear on a second cam surface 46b of a control gear 46 to be later explained. The release lever 36 is rotated responsive to rotation of the control gear 46 for moving the locking lever 33 to an unlocking position.

When the driving motor 28 is rotated with the sheet housing section 10 in the closed position and in the unlocked position, as shown in FIG. 12, the motor rotation is transmitted to the synchronizing shaft 20 for producing clockwise rotation of the arm members 21. The sub-chassis 7b, guided by the slide members 23, is pulled forwards, at the same time that it is rotated counterclockwise about the supporting pin 26 as the center of rotation, until the sheet housing section 10 is positioned at the open position, as shown in FIG. 13. The sheet housing section 10 is also restored to its closed position by the reverse of the above sequence of operations.

Figure 15:
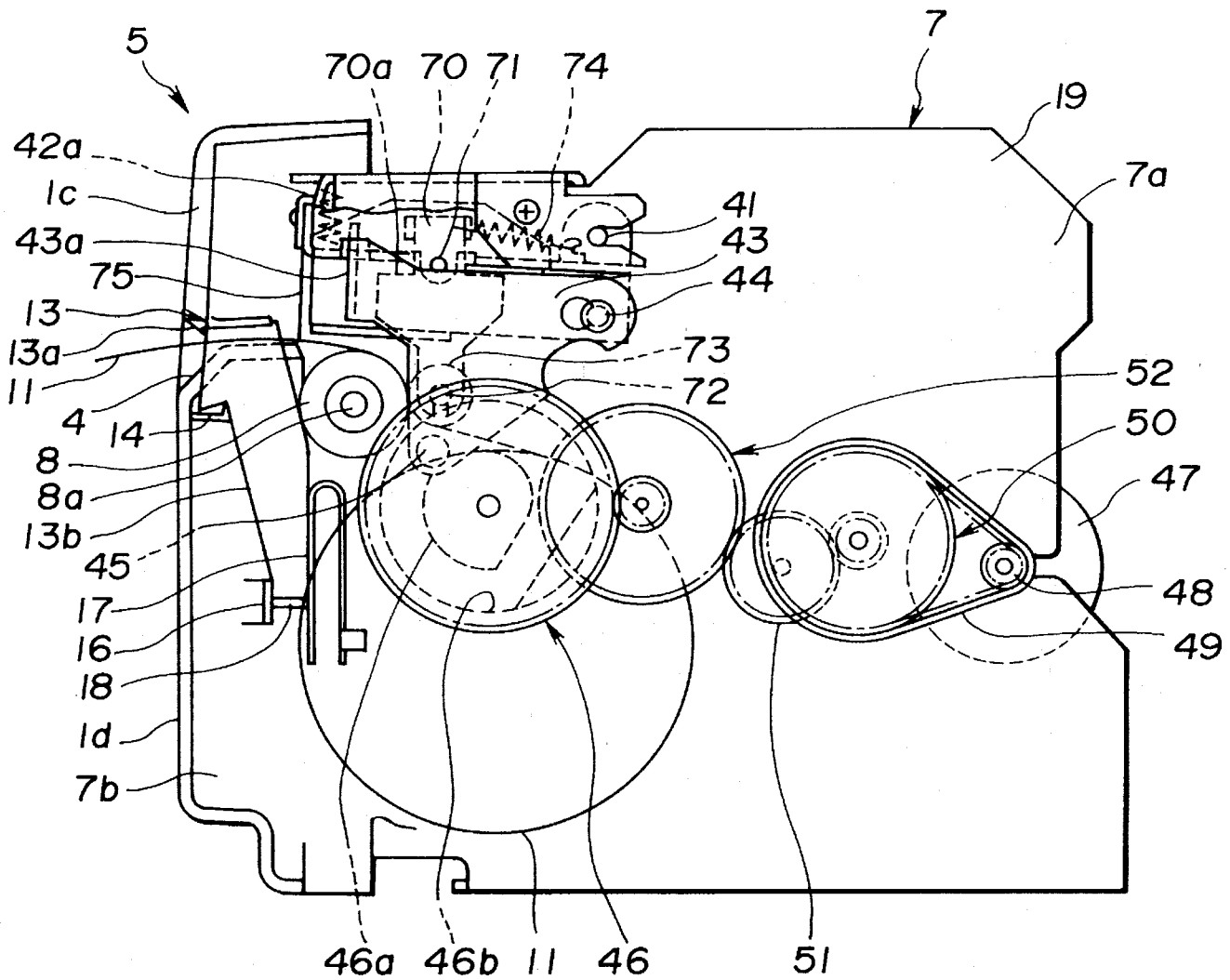
FIG. 15 is a right-hand side view mainly showing the head lift mechanism, shown with the thermal head in a stand-by position.
Figure 16:
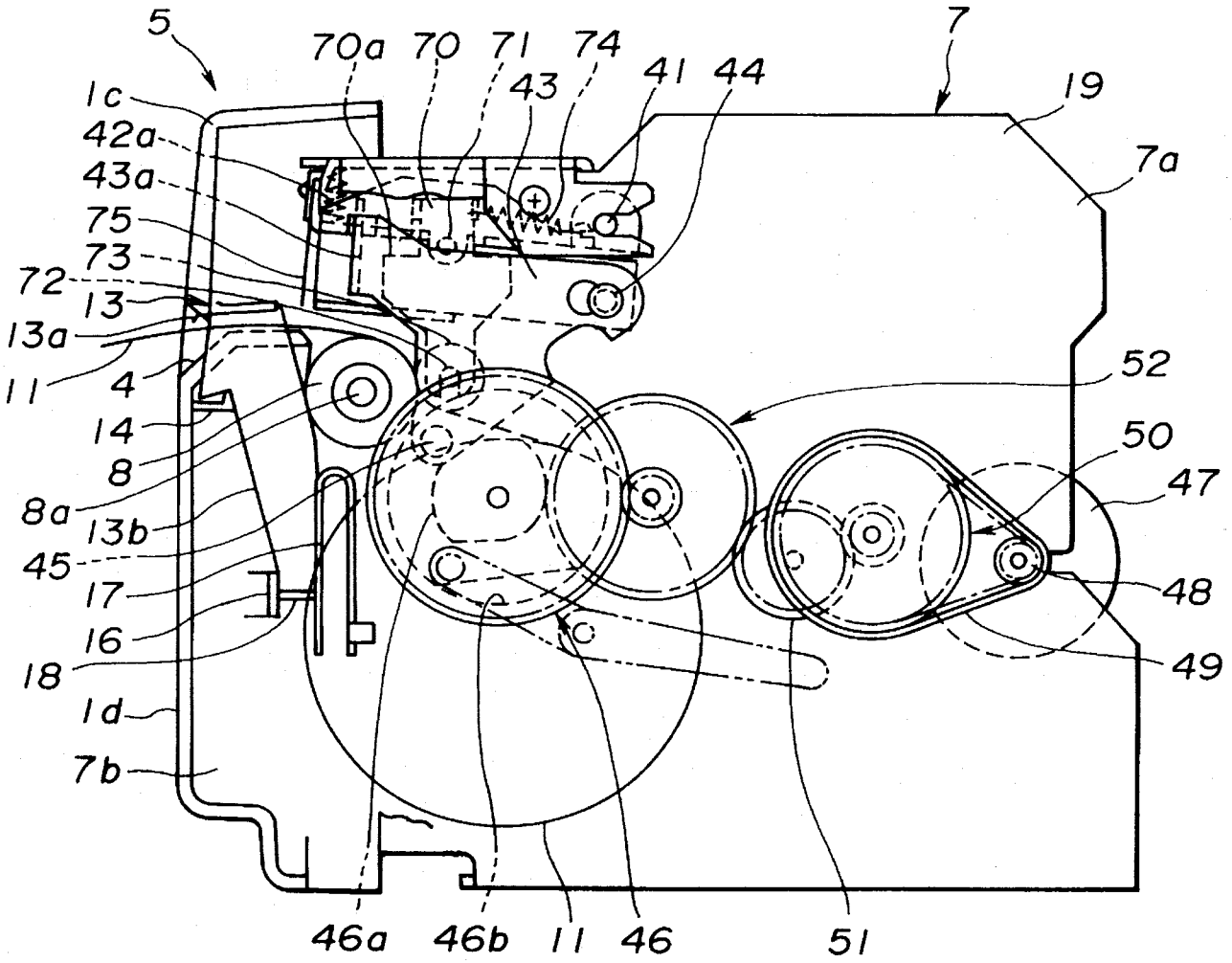
FIG. 16 is a right-hand side view mainly showing the head lift mechanism, shown with the thermal head in a space-apart position.

In FIGS. 14 to 16, the head lift unit, above all, is shown in right-hand side views. In these figures, the head lift unit is adapted for automatically moving the thermal head 12 between the pressure-contact position and the spaced-apart position. Referring to the construction of the head lifting unit, the head supporting member 40 has its rear end rotatably supported by a supporting shaft 41 at an upper end of the main chassis 7*a* and the thermal head 12 is secured to the lower end surface of the head supporting member 40, with rotation of the head supporting member 40, the thermal head 12 is moved between the pressure contact position in which it is pressure contacted with the platen 8 and the upper spaced-apart position well above the platen 8. The thermal head 12 is driven by a heat-sensitive driving circuit, not shown.

Figure 7:
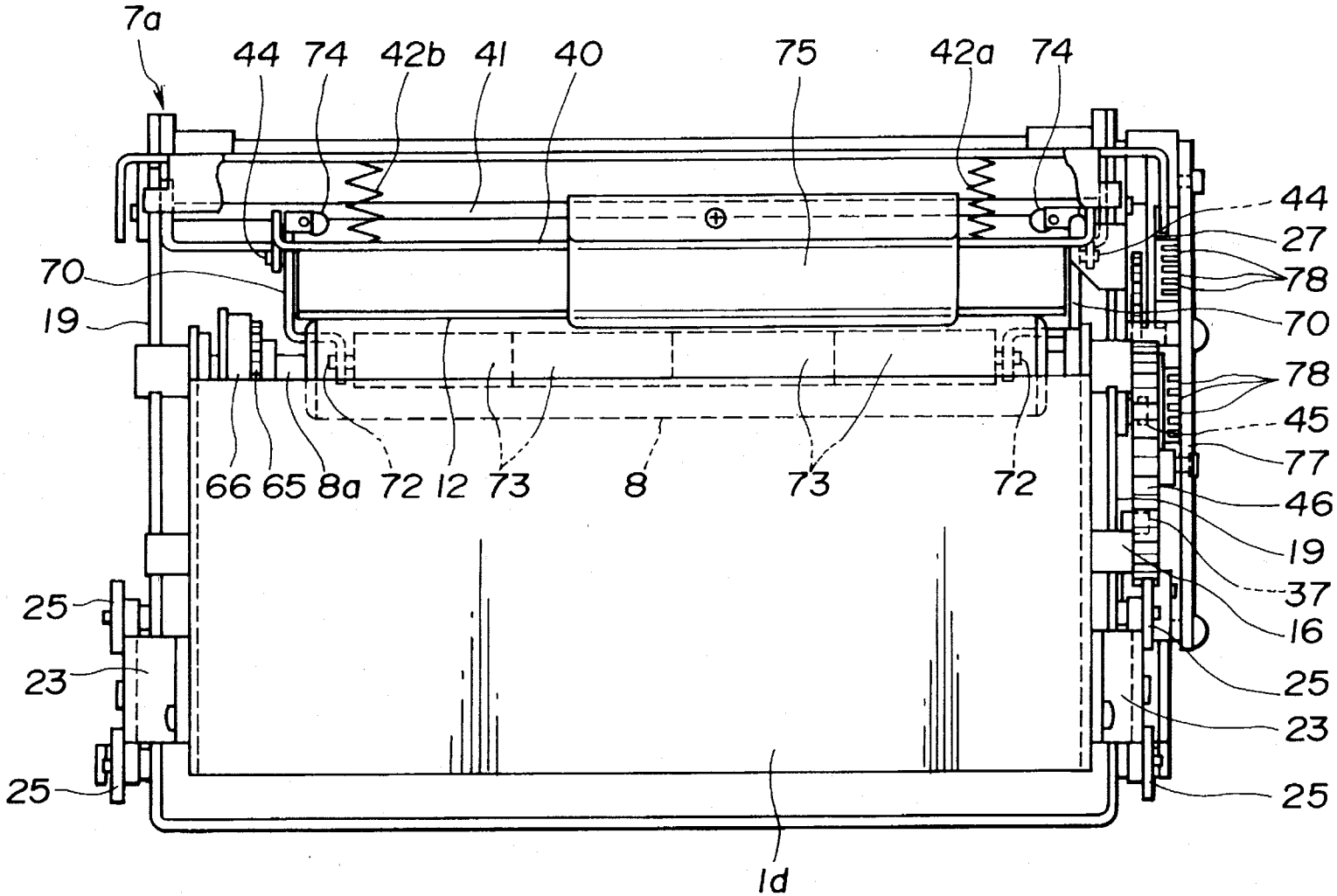
FIG. 7 is a front view of the printer, partially broken away.

Left and right compression springs 42*a*, 42*b*, shown in FIG. 7, are interposed between the upper surface of the head supporting member 40 and the main chassis 7*a*, and the thermal head 12 is biased towards the pressure contact position under the bias of the springs 42*a*, 42*a*. By these springs, the thermal head 12 is caused to bear against the platen 8 in the pressure-contact position.

A substantially triangular-shaped operating plate 43 has one of its apices supported for rotation by a right-hand side plate 19 by a supporting pin 44. A thrusting section 43*a* is provided at another apex of the operating plate 43 and is adapted for thrusting the lower surface of the head supporting member 40 by rotation of the operating plate 43. A cam pin 45 is provided at the remaining apex of the operating plate 43 and is caused to bear against a first cam surface 46*a* of a control gear 46.

The control gear 46 is supported by a right-hand side plate 19 and a first cam surface 46*a* and a second cam surface 46*b* are provided on an inner surface of the side plate 19. The first cam surface 46*a* is so designed that a distance from its center to its rim is gradually changed with changes in the angle of rotation so that the rotational position of the operating plate 43 is changed with rotation of the control gear 46. The second cam surface 46*b* is so designed that the distance from its center to its rim becomes shorter only at a part of its rim at which part the release lever 36 acts on the locking lever 33. Rotation of the driving motor 47 is transmitted to the control gear 46 via a gear 48 secured to the rotary shaft of the driving motor 47, timing belt 49 and three speed-reducing gears 50, 51, 52.

When the driving motor 47 is rotated while the thermal head 12 is in the pressure-contact position, as shown in FIG. 14, the motor rotation causes rotation of control gear 46. The cam pin 45 of the operating plate 43 is slid on the first cam surface 46*a* to cause the operating plate 43 to be rotated clockwise to cause the thrusting section 43*a* of the operating plate 43 to bear against the lower surface of the head supporting member 40. With rotation of the operating plate 43, the head supporting member 40 is moved upwards against the force of the compression springs 42*a*, 42*b* for positioning the thermal head 12 at a standby position shown in FIG. 15. If the operating plate 43 is rotated further from this position, the head supporting member 40 is moved upwards in the same manner as described above for positioning the head supporting member 40 at the spaced-apart position shown in FIG. 16. The thermal head 12 may also be moved from the spaced-apart position to the pressure-contact position through the standby position by the reverse of the above-described sequence of operations.

Figure 17:
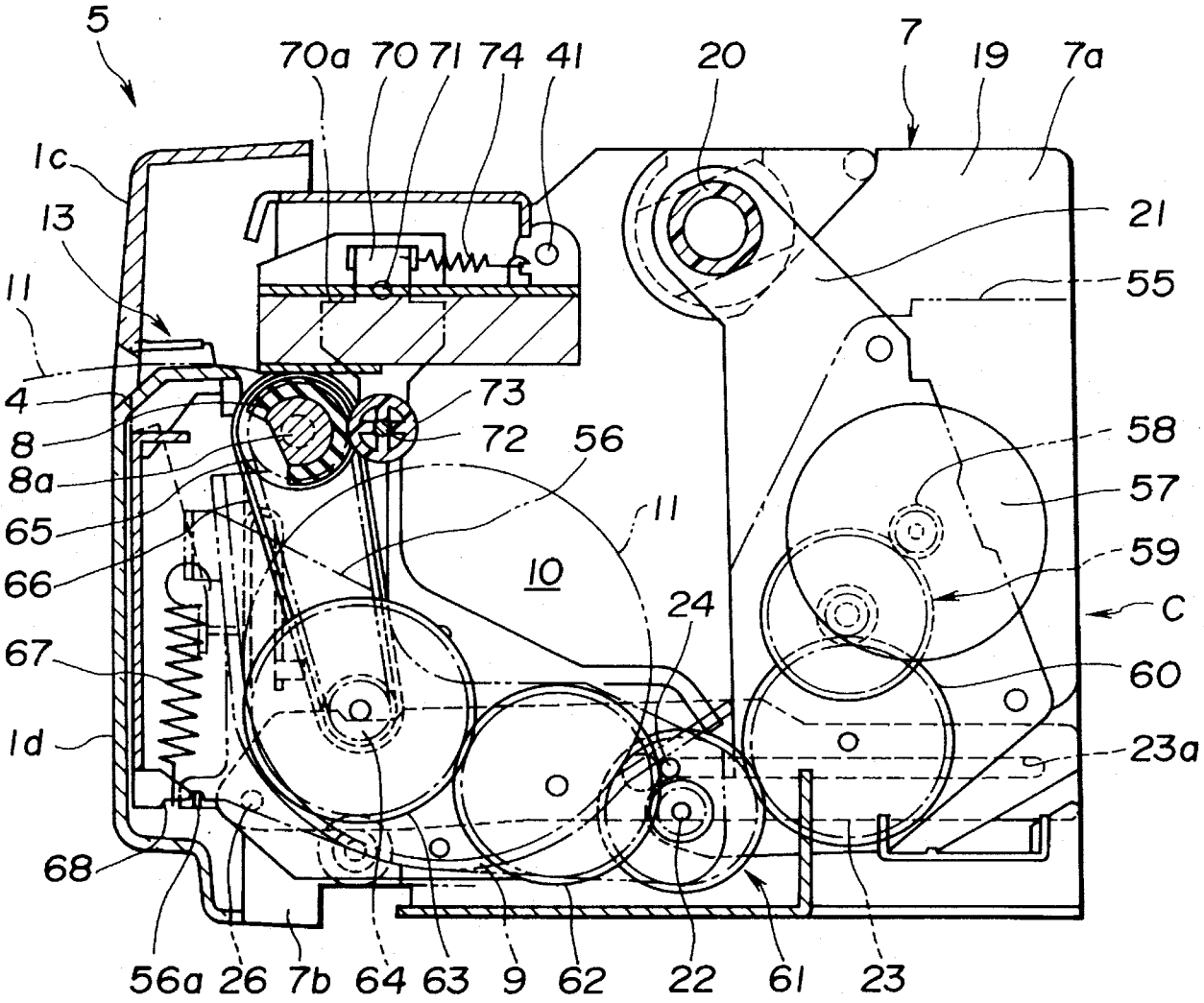
FIG. 17 is a cross-sectional view mainly showing a platen rotating mechanism, shown with the sheet housing section in the closed position.
Figure 18:
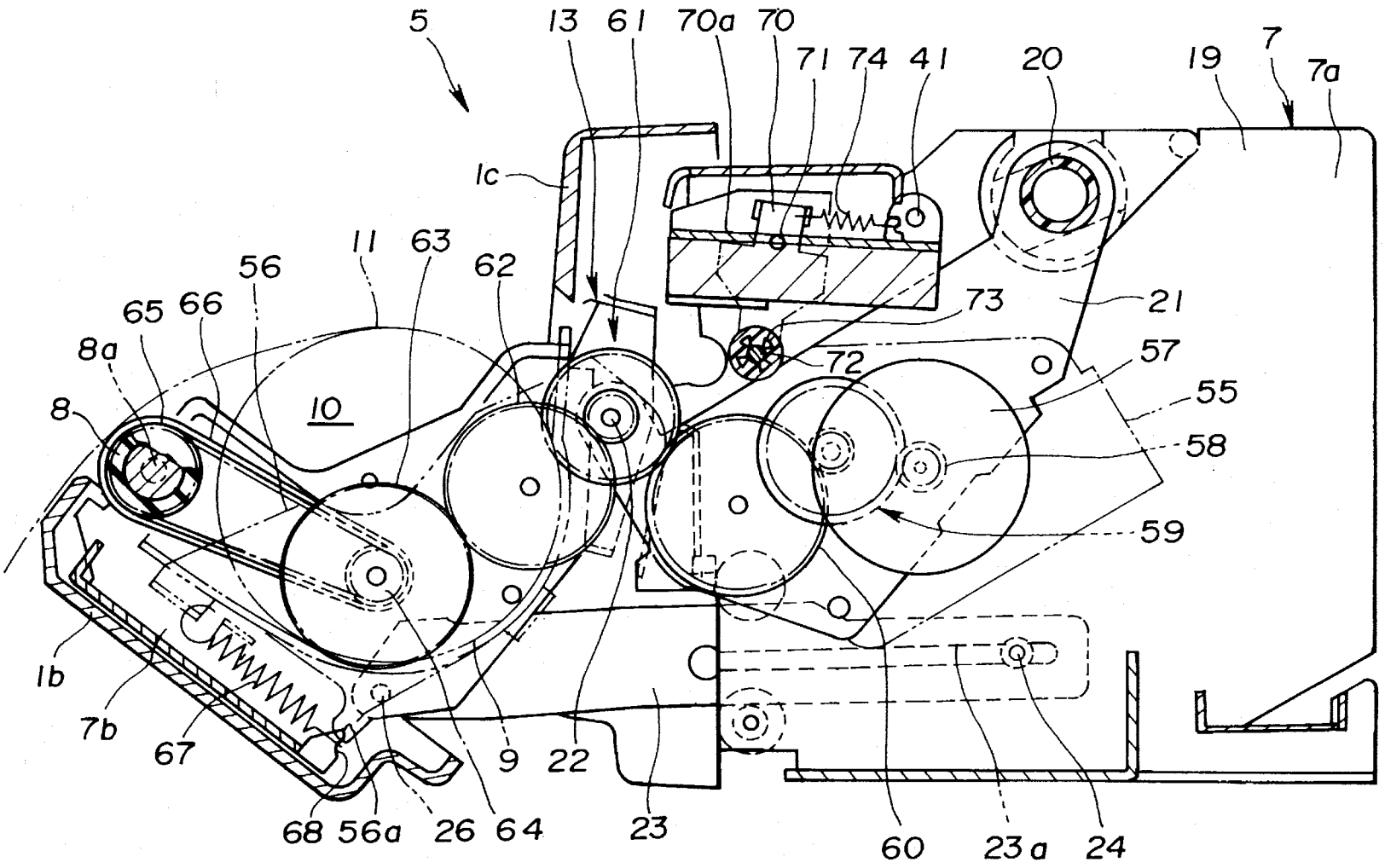
FIG. 18 is a cross-sectional view mainly showing a platen rotating mechanism, shown with the sheet housing section in the open position.

In the cross-sectional views of FIGS. 17 and 18, the platen rotating unit, above all, is shown. In these figures, the platen rotating unit has a first supporting plate 55 secured to the inner side of the left-hand side arm member 21 and a second supporting plate 56 secured to the inner left side of the sub-chassis 7*b*. The first supporting plate 55 carries a platen driving motor 57, a first speed-reducing gear 59 mashing with a gear 58 secured to the rotary shaft of the platen driving motor 57, and a gear 60 meshing with the first speed-reducing gear 59. The second supporting plate 56 carries a second speed-reducing gear 61 meshing with gear 60, a gear 62 meshing with the second speed-reducing gear 61 and a gear 63 meshing with the gear 62. The second speed-reducing gear 61 is supported with supporting pin 22 carrying the arm member 21 and the sub-chassis 7*b* as the center of rotation and is designed so that the distance between the centers of rotation of the second speed-reducing gear 61 and the gear 60 is not changed irrespective of the relative position between the arm member 21 and the sub-chassis 7*b*. Consequently, the second speed-reducing gear 61 is kept in meshing with gear 60 even although the sheet-housing section 10 is moved between the closed position shown in FIG. 17 and the open position shown in FIG. 18.

A small-sized gear 64 is mounted integrally with the gear 63 and a timing belt 66 is placed around the gear 64 and a gear 65 secured to shaft 8*a* of platen 8. The second supporting plate 56 is supported for rotation by means of the supporting pin 22. A tension spring 67 is mounted between the second supporting plate 56 and the sub-chassis 7*b* and a constant tension is applied by this spring to timing belt 66. A temporary spring retainer 56*a* is provided on the second supporting plate 56. Assembling may be made without being subject to the spring force of tension spring 67 if the tension spring 67 is retained at its one end by the retainer 56*a* during assembling of the second speed-reducing gear 61 and the one end of the tension spring 67 is retained by the spring retainer 68 on completion of assembling of the second speed-reducing gear 61 and the timing belt 66 etc.

On rotation of the above-described platen driving motor of the above-described platen rotating unit, the motor rotation is transmitted to the first speed-reducing gear 59, gear 60, second speed-reducing gear 61, gear 62 and gear 63 in this sequence and rotation of gear 63 is transmitted via timing belt 66 to cause rotation of platen 8.

Meanwhile, an FG fin, not shown, is mounted on a main shaft of the platen driving motor 57. A plurality of slits, each having a predetermined width, are arrayed at a constant pitch in the radial direction on the outer rim of the FG fin. A photo-interrupter, not shown, is provided on the outer rim of the FG fin provided with the slits so that these slits are sandwiched between the light emitter and the light receiver. Consequently, rotation main shaft of the platen driving motor 57 causes rotation of the FG fin. The light receiver of the photo-interrupter receives the light from the light emitting section transmitted through the slits of the FG fin. Consequently, FG pulses are generated from photo-interrupter. That is, the FG pulse indicates the amount of rotation and the rotational velocity of the platen 8.

Figure 19:
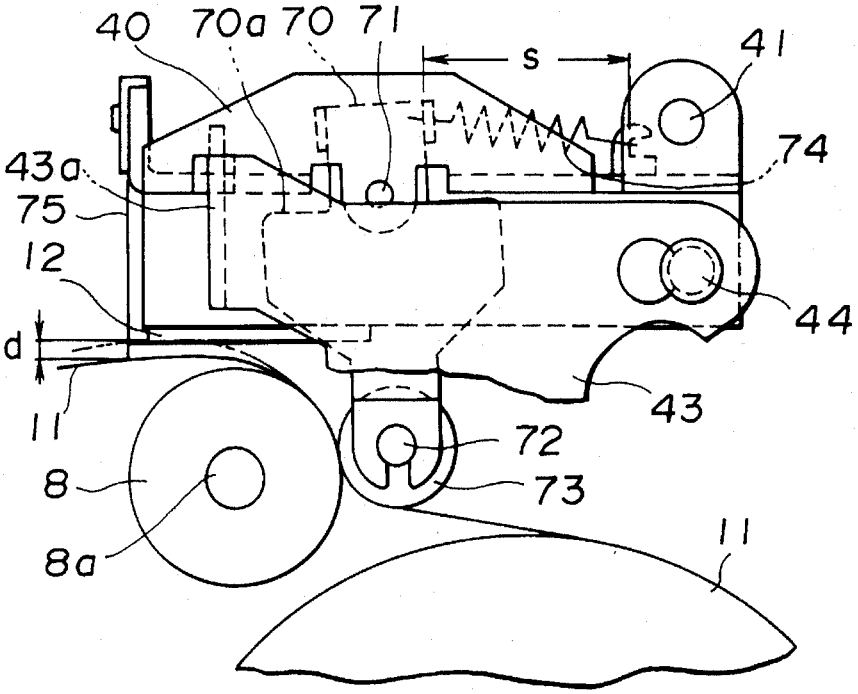
FIG. 19 is an enlarged side view showing the vicinity of the thermal head positioned at the standby position.
Figure 20:
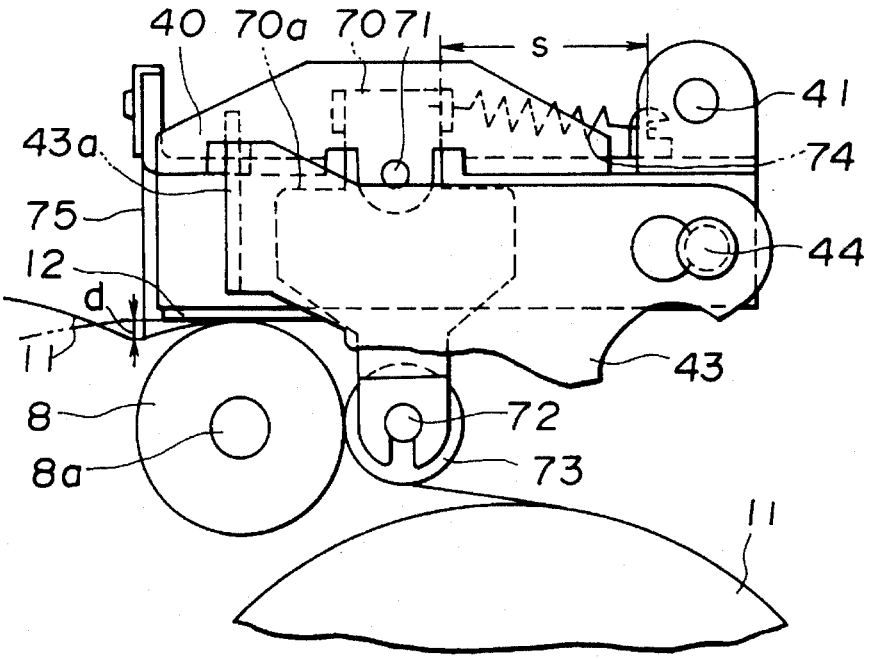
FIG. 20 is an enlarged side view showing the vicinity of the thermal head positioned at the pressure contact position.

In the enlarged side views of FIGS. 19 and 20, the thermal head 12 and its vicinity are shown. In FIGS. 19 and 20, the head supporting member 40 carried a roll supporting member 70 via a supporting pin 71. A shaft 72 is secured to the lower end of the roll supporting member 40 and a plurality of rolls 73 are supported for rotation by shaft 72. The roll 73 has a shaft 72 arranged parallel to a shaft 8*a* of platen 8. A tension spring 74 is mounted between the upper end of the roll supporting member 70 and the head supporting member 40 for biasing the roll 73 towards platen 8. When the sheet housing section 10 is not at the closed position, a stop end face 70*a* is caused to bear against the head supporting member 40 for position regulation. When the sheet housing section 10 is at the closed position, roll 73 is caused to bear against platen 8. However, when the thermal head 12 is at the pressure-contact position, the tension spring 73 has a short stroke S to produce a weak pressure-contact force, whereas, if the thermal head 12 is at the standby position, the tension spring 73 has the long stroke S to produce a strong pressure-contact force.

A sheet-pressor plate 75 is formed of a material exhibiting low heat conductivity and is secured to the forward end of the head supporting member 40. The sheet pressor plate 75 has its lower end positioned at a level lower by d below the lower surface of the thermal head 12 and is moved along with the thermal head 12 so as to be protruded below the thermal head 12.

Reverting to FIGS. 6 and 7, the printed base plate 77 is supported by the right-hand side plate 19 of the main chassis 7*a* at a predetermined distance and carries the ends of gear shafts. The control gear 46 and the sector gear 27 are provided with contractors 78 which are contacted with a print pattern of the printed base plate 77 for constituting rotary position sensors for the control gear 46 and the sector gear 27.

The operation of printing an image by the video printer according to the present invention is explained with reference to a control circuit controlling the image printing operation.

Figure 1:
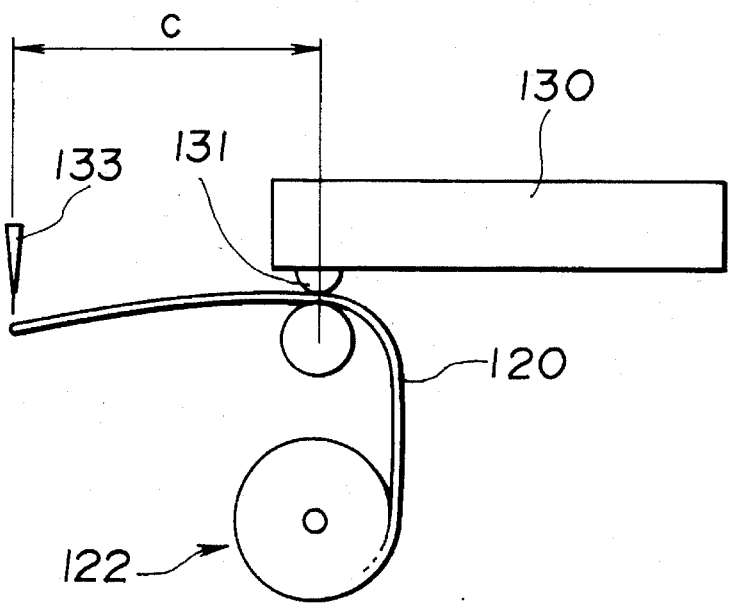
FIG. 1 is a schematic view for illustrating the defects inherent in a conventional video printer.

When starting printing on the transfer sheet 11, the video printer is reversed in a direction opposite to the sheet feed-out direction by an amount corresponding to a distance between the thermal head 12 and the cutter 13 (distance c shown in FIG. 1).

That is, when the printing of an image on the transfer sheet 11 by turning on the switch 42*a* of the operating switches 22 provided on the operating panel 1*c* of the present video printer, platen 8 is rotated for rewinding the transfer sheet 11 towards the sheet housing section 10 as shown by arrow e. The direction in which the transfer sheet 11 is returned in the direction shown by arrow e is referred to hereinafter as the reverse direction. By the rotation of platen 8 in the reverse direction. The rewind amount of the transfer sheet 11 by the reverse rotation of platen 8 is not more than the distance c shown in FIG. 1.

In other words, when starting printing on the transfer sheet 11, the platen driving motor 57 is rotated in reverse for capturing the transfer sheet 57. The capturing quantity of the transfer sheet 11, which is not more than the distance c of FIG. 1, is detected by counting the number of FG pulses produced by the photo-interrupter and the FG counter provided on the main shaft of the platen driving motor 53.

After rewinding the transfer sheet 11, the platen driving motor 57 and hence the platen 8 are driven forwards for starting the printing operation.

It is noted that, if the transfer sheet 11 is captured excessively, the transfer sheet 11 tends to be jammed on switching the platen driving motor 57 and hence the platen 8 in a forward direction, so that it becomes necessary to take some protective measures. In the present embodiment, such protection is provided on the basis of the elapsed time and detection of the transfer sheet 11 by the photosensors. That is, reverse rotation of the platen driving motor 57 is stopped when a preset number of FG pulses is not counted after lapse of a predetermined time and/or when the transfer sheet 11 is rewound excessively and the photosensor is turned on, that is when it has been found that there is no transfer sheet 11.

Figure 21:
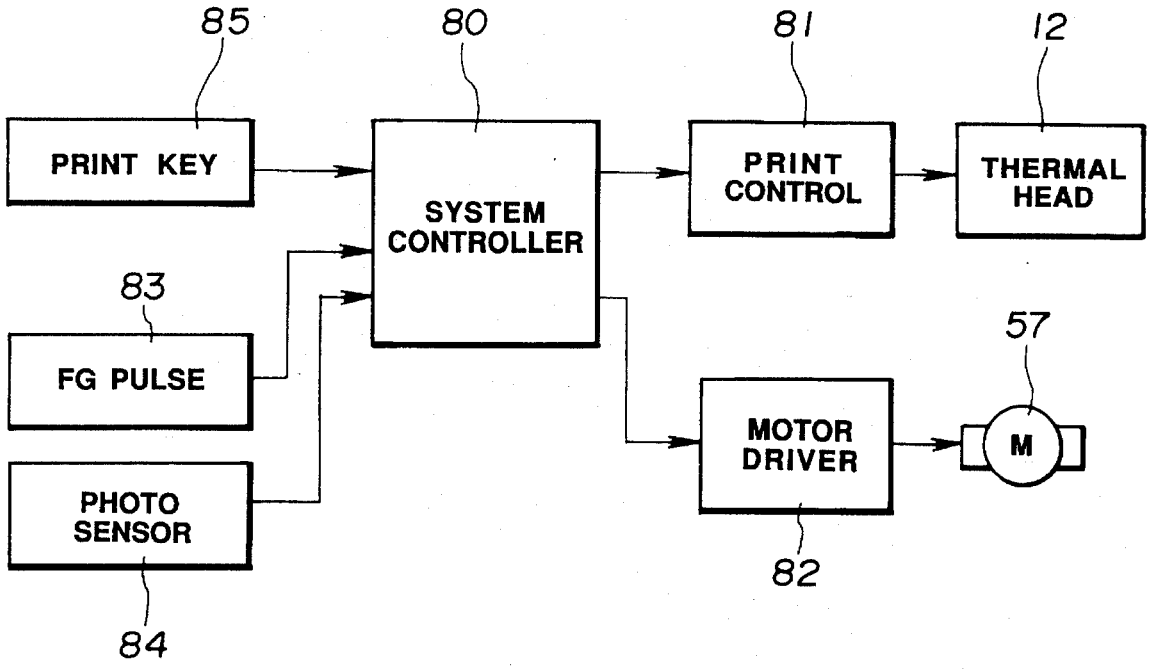
FIG. 21 is a schematic block circuit diagram of a video printer according to the present invention.

FIG. 21 shows, in a concrete block circuit diagram, the video printer of the present embodiment for controlling the above-mentioned controlling operation.

Referring to FIG. 21, the video printer of the present embodiment comprises a printing start signal entry section 85, which is the above-mentioned printing key 2*a*, an FG pulse generator 83, which is made up of the FG fin provided on the main shaft of the platen driving motor 57 and the photo-interrupter provided on both sides of the FG fin, a photosensor section 84, which is made up of a light emitter and a light receiver for detecting the possible presence of the transfer sheet 11, a printing control section 81 for driving the thermal head 12 based on video signals, a motor driver 82 for driving the platen driving motor 82, and a system controller 80 for controlling various components.

FIG. 21 shows, by a flow chart, the controlling operation performed by the system controlling section 80.

Figure 22:
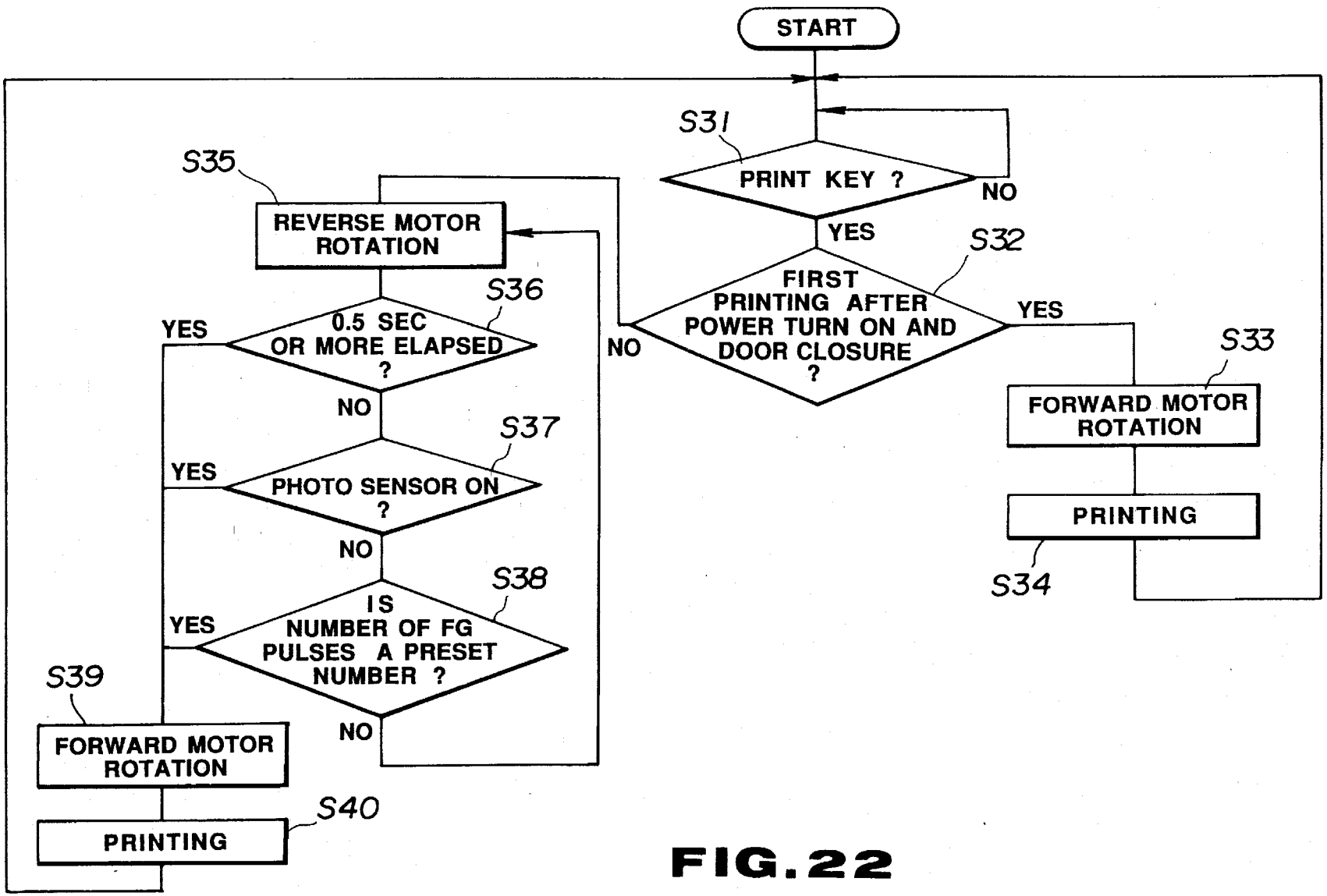
FIG. 22 is a flow chart for a system controller of the video printer shown in FIG. 21.

Referring to the flow chart of FIG. 22, it is checked at step S31 if the printing key 2*a* has been turned on. It is decided at step S31 that the printing key 2*a* has not been turned on (NO), the process of step S31 is repeated. If it is decided that the printing key 2*a* has been turned on (YES), control proceeds to step S32.

At step S32, it is checked if the printing by the turning on of the printing key 2*a* is the first printing after the entrance/exit opening of the sheet housing section 10 for loading the transfer sheet 11 and after turning on of the power source of the video printer. If the result of checking at step S32 is YES, that is the printing is decided to be the first sheet, control proceeds to step S33. If the result of checking is NO, that is if the printing is decided to be the second or some later printing, control proceeds to step S35.

At step S33, the platen driving motor 57 and hence the platen 8 are rotated forwards, after which the print control section 81 is commanded to perform a printing operation.

At step S35, the platen driving motor 57 and hence the platen 8 are rotated in reverse. Then, at step S36, it is checked if 0.5 second, for example, as the elapsed time, or more, has elapsed. If it is decided that 0.5 second or more has elapsed (YES), control proceeds to step S39 and, if it is decided that the elapsed time is less than 0.5 second, control proceeds to step S37.

At step S37, it is checked if the sensor 84 has been turned on. If it is decided that the sensor 84 has been turned on (YES), control proceeds to step S39. If it is decided that the photosensor has not been turned on, control proceeds to step S38.

At step S38, it is checked if the number of FG pulses generated by FG pulse generator 83 has reached a preset value. It is decided that the number has reached the preset value (YES), control proceeds to step S39 and, if it is decided that the number has not reached the preset value, control reverts to step S35.

At step S39, the platen driving motor 57 and hence the platen 8 are rotated forwards. Then, at step S40, the print control section 81 is commanded to perform the printing operation.

That is, when the printing key 2*a* of the video printer of the present invention is actuated, it is checked by the system controller 80 if the printing is the first printing after turning on of the power source and after closure of the sheet housing section 10. It is because there is the risk that the foremost part of the transfer sheet 11 be not at the position of the cutter 13 if the transfer sheet 11 is set in an incorrect manner, in which case the sheet is not captured for printing inasmuch as the transfer sheet would be captured excessively if it were captured by a normal quantity. If the printing is made on the first sheet, the printing operation is performed in a usual manner.

Figure 23:
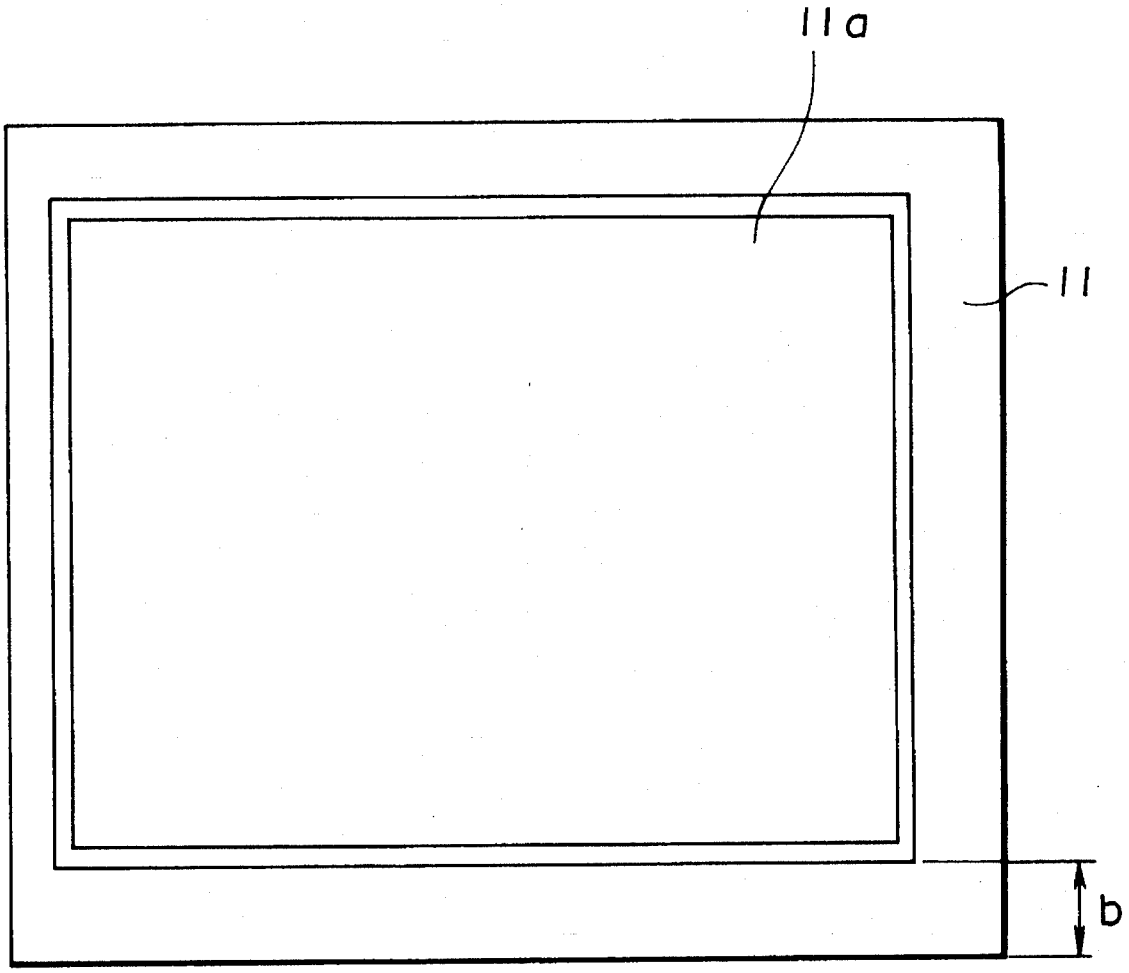
FIG. 23 shows a transfer sheet printed by the video printer of FIG. 21 and severed.

It will be seen from above that the number of times of printing per transfer roll may be increased with the present video printer by reducing the margin. the quantity of the margin b that is the space left between the printed image 11*a* on the printed sheet 11 and the severed portion is on the order of approximately 15 mm, as shown in FIG. 23, so that the number of times of printing per transfer roll may be increased from about 205 in the case of the conventional video printer to about 235 in the case of the present video printer.

Figure 27:
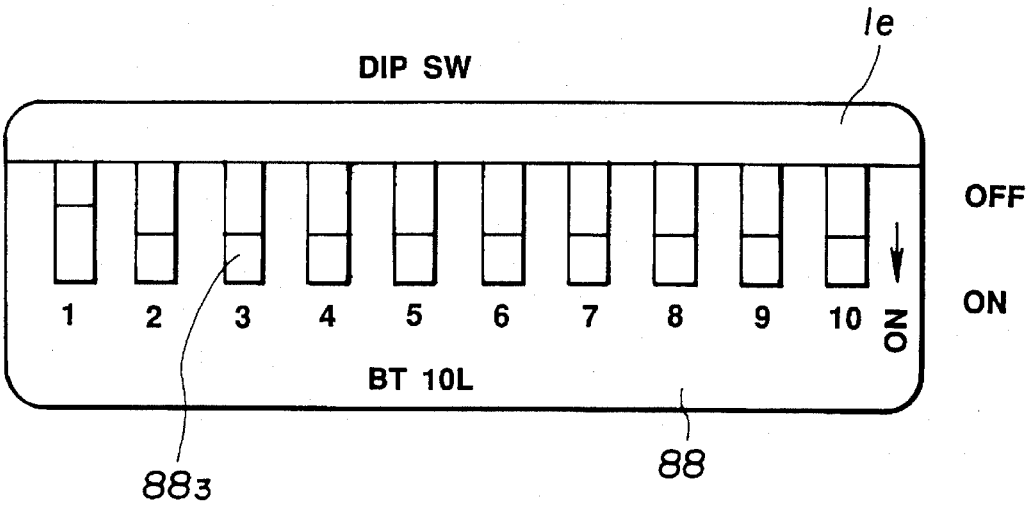
FIG. 27 is a front view showing a DIP switch.

Besides, the video printer of the present invention has an input section 85 which plays the part of switching means for switching the feed quantity of the transfer sheet 11 between printing units when printing plural images on the transfer sheet 11, that is the margin, in plural stages, and which is provided with a post-feed switch $\mathbf{88}_3$ as shown in FIG. 27. Besides, the feed quantity of the transfer sheet 11 between the printing units is controlled by system controller 80 responsive to the changeover signals from the input section 80.

That is, it is possible with the video printer according to the present invention to print plural images on the transfer sheet 11. That is, with the video printer of the present invention, it is possible to change over the feed quantity of the transfer sheets between the printing units, that is the quantity of margin, when printing plural images on the transfer sheets 11. Meanwhile, the printing of plural images on the transfer sheet 11 may be realized by turning on the copy key 2*b* shown in FIG. 6 by a number of times equal to the number of the sheets to be printed.

The feed quantity of the transfer sheets between the printing units is changed over by the post feed switch $\mathbf{88}_3$. That is, the feed quantity of the transfer sheet 11 between the printing units is controlled by the system controller 80 by the software methodology. Meanwhile, the margin feed quantity is controlled in two stages by means of the post-feed switch $\mathbf{88}_3$ performing two-stage changeover between the ON and OFF states.

Figure 3:
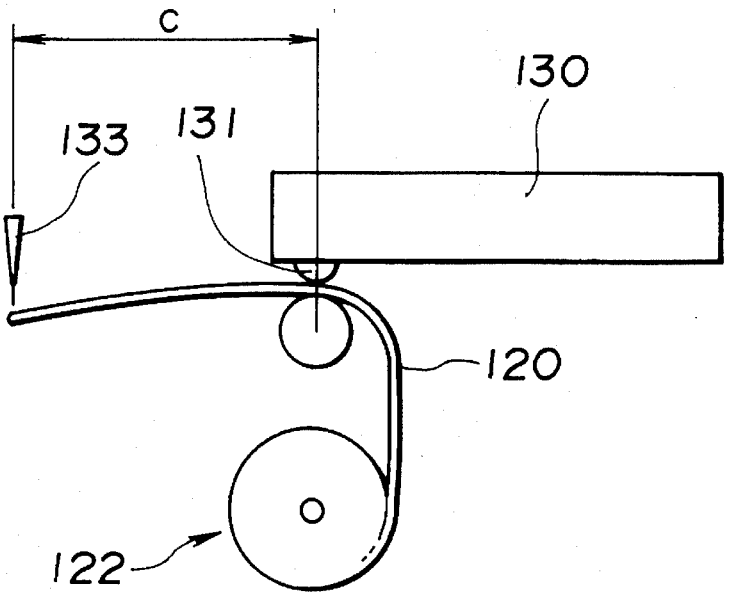
FIG. 3 is a schematic view showing the construction of the conventional video printer.

That is, if the post-feed switch $\mathbf{88}_3$ is ON, system controller 80 controls the feed quantity of the transfer sheet 20 so that the quantity of margin taking account of severing of the transfer sheet 11 as described with reference to FIG. 3, that is an optimum length A for severing the transfer sheet 11 corresponding to the distance c or about 15 mm. If the post-feed switch is OFF, system controller 80 controls the feed quantity of the transfer sheet 11 between the printing units so that the margin is equal to a minimum length B of e.g. 5 mm necessary to discriminate the printing units from one another.

The video printer of the present invention, adapted for controlling the feed quantity as described above, is arranged and constructed as shown in FIG. 21. The post-feed switch $\mathbf{88}_3$ is provided in the entry section 85.

Figure 25:
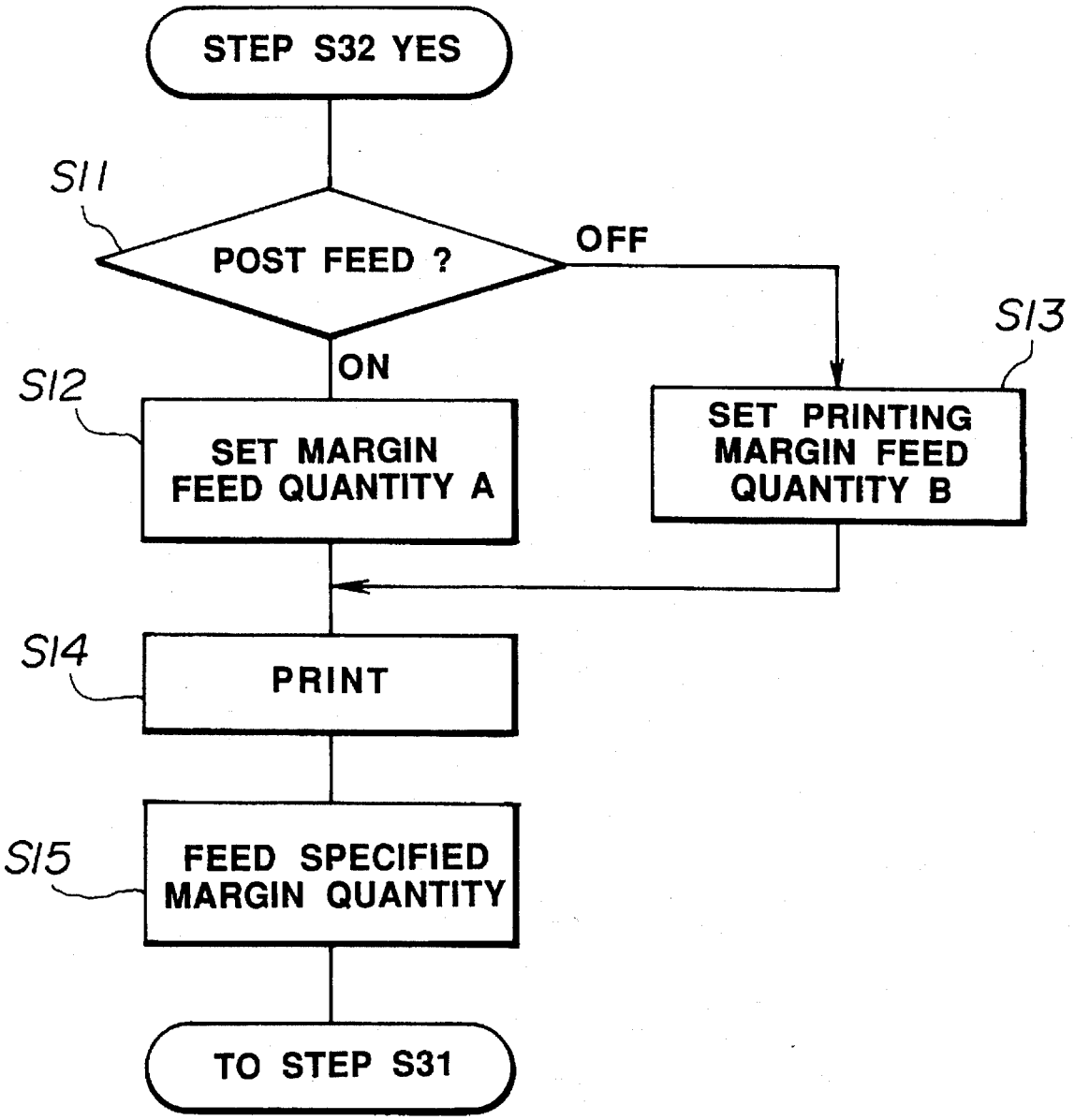
FIG. 25 is a flow chart for transfer sheet feed control by the system controller of the video printer shown in FIG. 21.

FIG. 25 shows, in a flow chart, the controlling operation performed by the system controller 80. The flow chart of FIG. 25 shows details of steps S33, S34 of the flow chart of FIG. 22.

That is, if the result of checking at step S32 of the flow chart of FIG. 22 is YES, control proceeds to step S11 of the flow chart of FIG. 25, by way of the operations at steps S33, S34 of FIG. 4.

At step S11, it is checked if the post-feed switch $\mathbf{88}_3$ is ON or OFF. If it is decided at step S11 that the post-feed switch $\mathbf{88}_3$ is ON, control proceeds to step S12 and, if it is decided that the post-feed switch $\mathbf{88}_3$ is OFF, control proceeds to step S13.

At step S12, system controller 80 sets the feed quantity of the transfer sheet 11 by the platen 8 between the printing units so as to be equal to the above-mentioned margin quantity or length A. On the other hand, at step S13, system controller 80 sets the feed quantity of the transfer sheet 11 by the platen 8 between the printing units so as to be equal to the above-mentioned margin quantity or length A.

After steps S12 and S13, control proceeds to step S14. At step S14, system controller 80 controls the print control section 81 for driving the thermal head 81 for driving the motor driver 82, while controlling the motor driver 82 for driving the platen motor 57 for printing the image.

When the printing is completed at step S14, the motor driver 84 is controlled for rotating the platen driving motor 57 so that the feed quantity between the printing units is equal to the lengths A or B preset in the system controller 80. Control then reverts to step S31 of the flow chart of FIG. 22.

With the above-described video printer of the present invention, the length of the transfer sheet 11 required per printing is decreased to realize saving in the transfer sheet. That is, the number of times of printing per transfer roll may be increased by diminishing the margin. For example, in the present embodiment, the number of times of printing per transfer roll may be increased to about 270 by using the length or margin B from about 230 in the case of the conventional video printer. The feed time for the transfer sheet 11 may be decreased by reducing the margin for correspondingly increasing the chance of printing.

Figure 24:
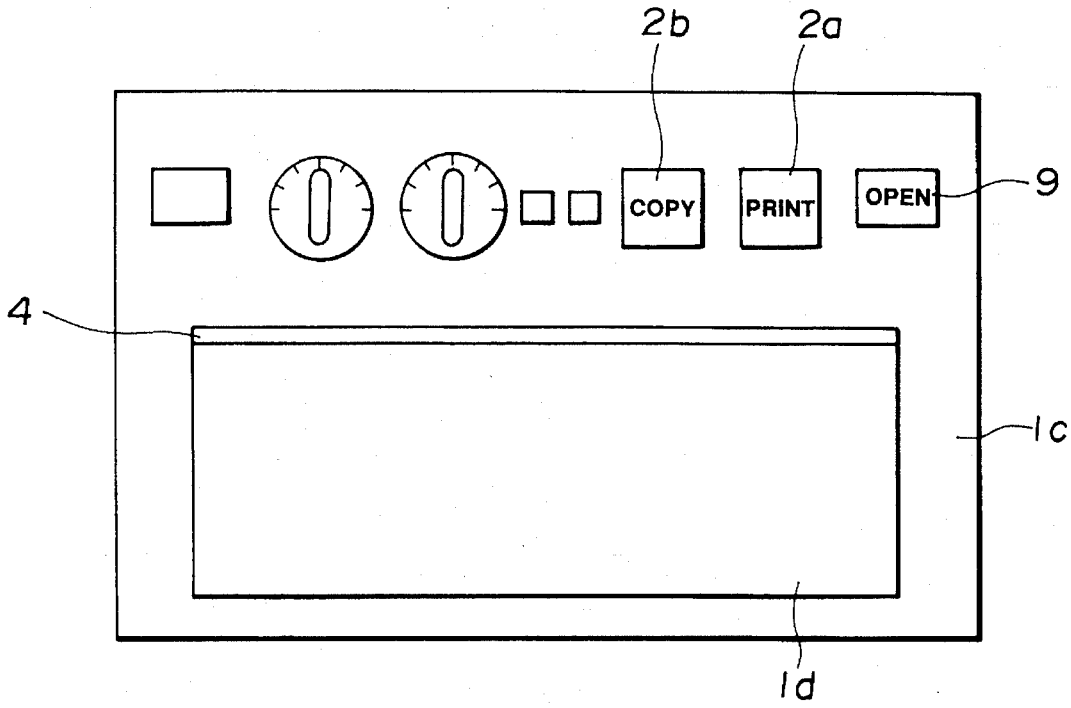
FIG. 24 is a schematic front view showing an operating panel of the video printer shown in FIG. 21.
Figure 26:
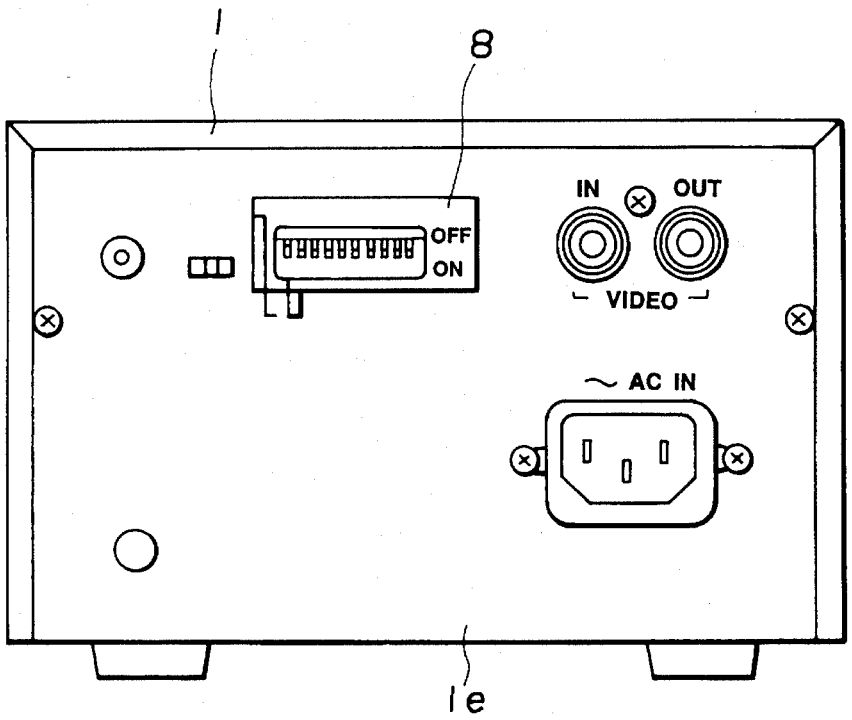
FIG. 26 is a back side view of the video printer shown in FIG. 21.

Meanwhile, the roll-shaped transfer sheet 11 is loaded in the openable sheet housing section 10, as shown in FIG. 24. Besides, with the present video printer, the role of the printing stop key is played simultaneously by the opening key 90 adapted for opening the sheet housing section 10. That is, since the sheet hosing section 10 is usually adapted for not being opened during the printing operation, the opening key 90 may be simultaneously used as the stop key during the printing operation without any conveniences, while there is no necessity of providing a new stop key.

Figure 2:
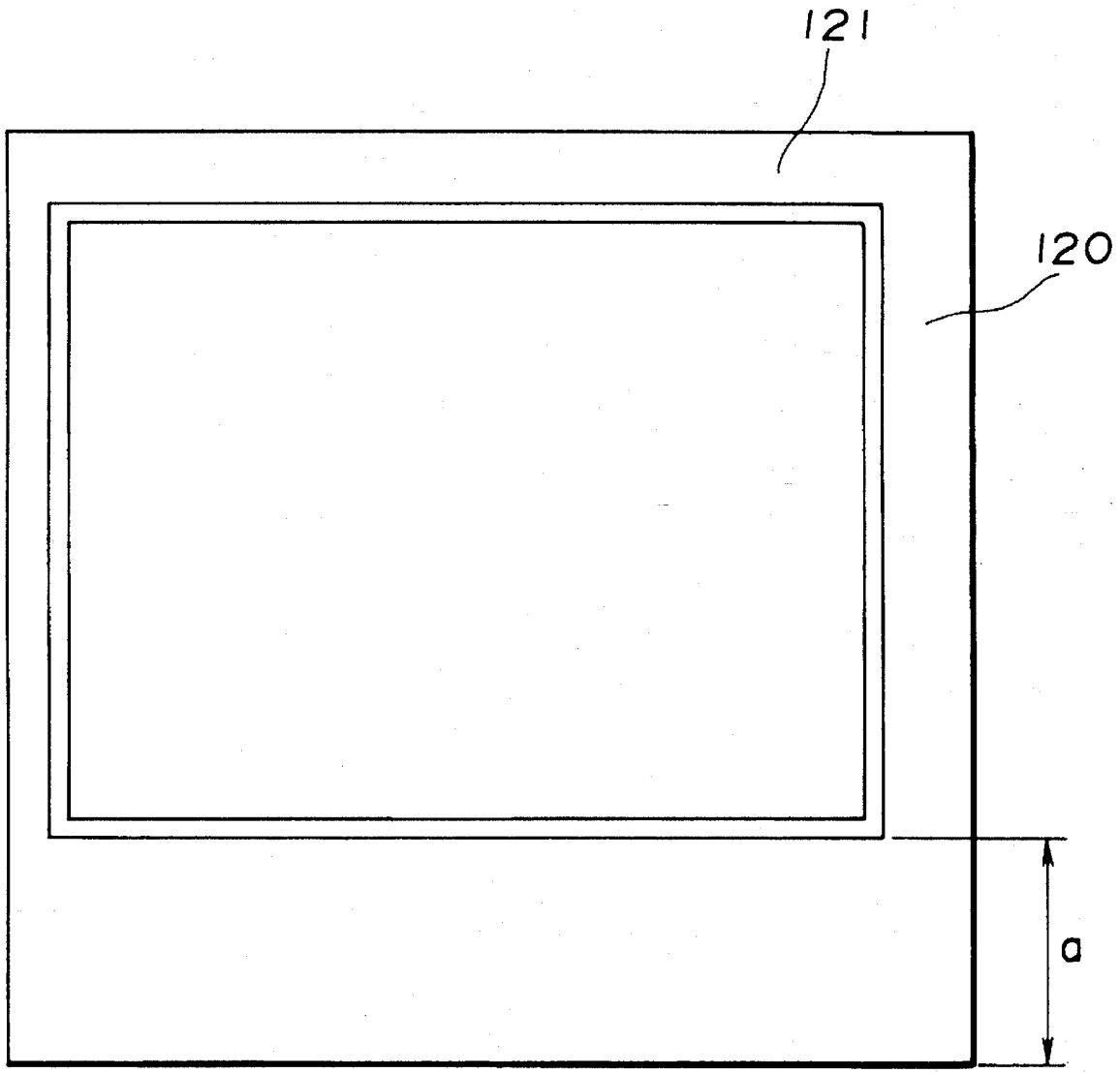
FIG. 2 is a plan view showing a transfer sheet printed by the conventional video printer and severed.

With the present embodiment, the post-feed switch $\mathbf{88}_3$ is set as, for example, the third switch $\mathbf{88}_3$ of the DIP switch 88 provided on the rear panel 1*e* of the rear panel as shown in FIG. 2*e*.

With the present video printer, printing start input means, that is printing key 2*a*, for inputting the start of printing, and number of printing sheets input means for setting the number of times of printing of the same image, that is copy key 2*b*, are provided on the operating panel 1*c* of the video printer, as shown in FIG. 24. The number of times of printing is set by plural on operation of the printing key 2*a* during the printing operation of an image responsive to the On operation of the print key 2*a* continuing for e.g. four seconds for producing a desire number of the printed sheets.

The video printer of the present invention also includes confirmation means for prompting the user to aurally or visually confirm the setting. Although not shown, these confirmation means include a buzzer enclosed within a casing, not shown, or LEDs provided on the operating panel 1. When the required number of the sheets is set by the copy key 3, the buzzer or the LED is activated responsive to the On operation of the copy key 26 for prompting the user to confirm the number of times of printing as set on the video printer.

FIG. 10 shows a detailed construction of the system controller 80 of the video printer realizing the function of the present invention. In FIG. 27, an operating panel block 91, provided with the printing key 85 shown in FIG. 21, copy key 2*b* of FIG. 24 and opening key 90 and a confirmation block 95 provided with the buzzer and/or LEDs are shown simultaneously. [0020]

Figure 28:
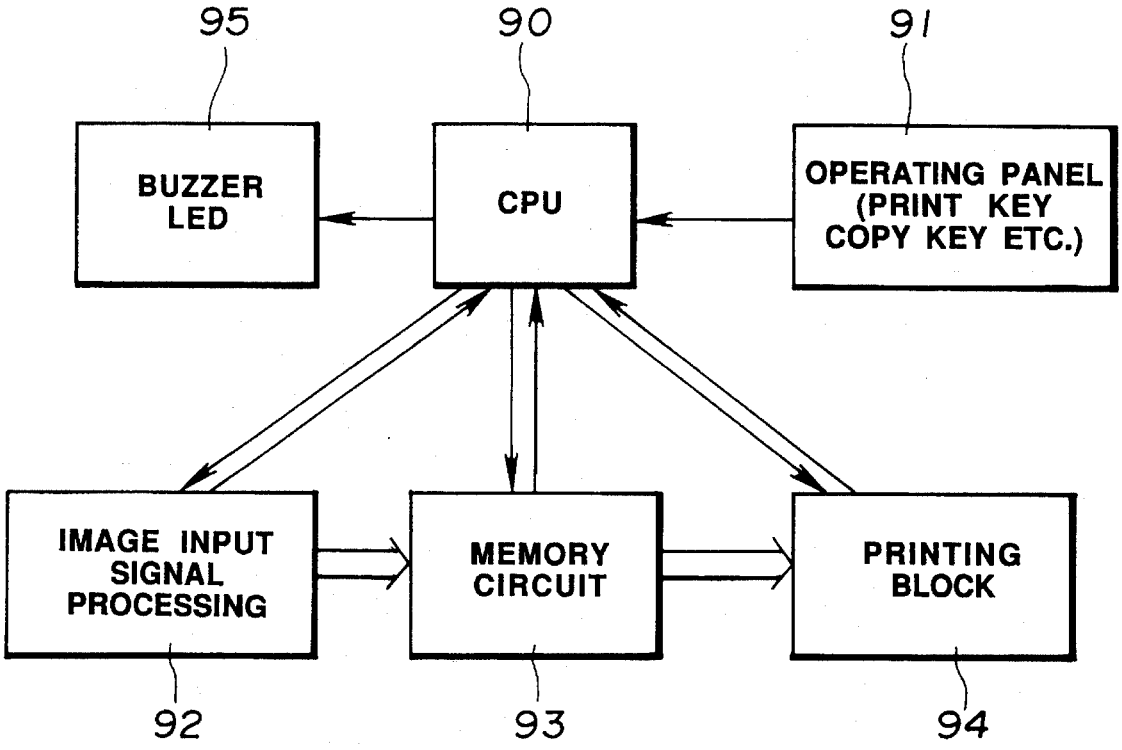
FIG. 28 is a block circuit diagram of the system controller of the video printer shown in FIG. 21.

In FIG. 28, the signal input processing section 92 for entry of image signals and for processing the entered video signals is an image entry unit of the video printer itself or a block for processing image signals from outside. A memory circuit 93 is a block for storage of image signals or video data processed by the image input processing section 92, that is an image memory. It is the video data read from memory circuit 93 that is transmitted to a printing block 94. The printing block 94 transforms video data from memory circuit 93 into an image which is transmitted to the print control section 50 shown in FIG. 21. The sequence of operations performed by the image input processing section 92, memory circuit 93 and the printing block 94 is controlled by CPU 90 based on instructions from operating panel block 91 provided with the printing key 2*a* and the copy key 2*b*. The CPU 90 also controls the sound produced by the buzzer or light radiation by the LED.

Figure 29:
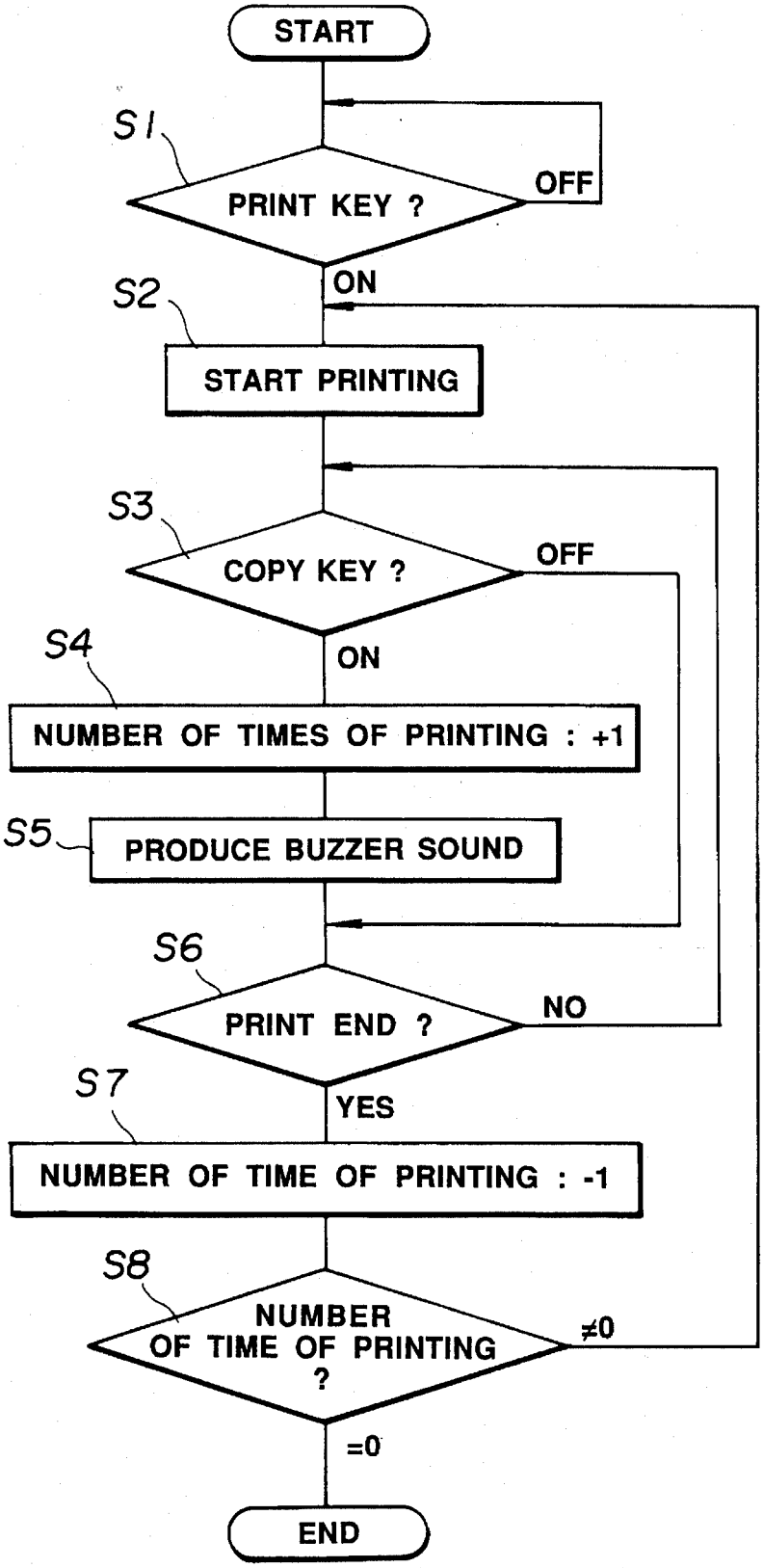
FIG. 29 is a flow chart for illustrating a CPU operation according to the present invention.

FIG. 29 shows, by a flow chart, various control operations performed by CPU 90 of the video printer of the present invention.

In the flow chart of FIG. 29, it is checked at step S1 if the printing key 2 is ON or OFF. If the printing key is OFF, the operation of step S1 is repeated. If the printing key is OFF, the control proceeds to step S2. At step S2, the printing block 14 is controlled to start one printing operation before control proceeds to step S3.

If it is decided at step S3 that the copy key 2*b* has been turned on, the number of times of printing as set by the copy key 2*b* is counted, that is the number of times of the copy key being turned ON is counted, that is, '1' is added each time the copy key 3 is turned on. At step S5, the confirmation block 95 is controlled to produce e.g. the buzzer sound responsive to the tuning on of the copy key 3.

At step S6, it is checked if the printing is terminated. If it is decided that the printing is not terminated (NO), control reverts to step S3. If it is decided that the printing is terminated (YES), control passes to step S7.

At step S7, the remnant number of times of printing is checked, based on the printing end information at step S6, that is, the preset number of time of printing is decremented by '1' each time printing is terminated.

At step S8, it is checked if the remnant number of times of printing is zero, that is if printing has been carried out by the preset number of times of printing. If it is decided that the remnant number of times of printing is not zero, control proceeds to step S2. If it is decided that the remnant number is zero, the processing operation is terminated.

In other words, with the above flow chart, printing is started by the printing key 2 at step S1, and the status of the copy key 3 is checked at step S3. If the processing operation is not at an end, the number of times of printing is incremented by '1' at step S4 and the buzzer sound is produced at step S5. It is checked at step S6 if the printing is at an end. If the printing is not at an end, the status of the copy key 3 is again checked at step S3. If the printing is found at step S6 to be at an end, the number of times of printing is decremented at step S7. If the number of times of printing is zero at step S8, processing is terminated. If otherwise, control reverts to step S2 to repeat printing.

With the video printer according to the present invention, since the number of times of printing is set during first printing, the time for setting the number of times of printing is not required. Besides, the number of times of printing can be set easily by the operation of the copy key 2*b* without the necessity of selecting a special mode for setting. In addition, since the number of times of printing may be confirmed by e.g. the buzzer sound, there is no necessity for providing a space for display means for confirming the number of times of printing, so that the video printer may be reduced in size. If the confirmation means is a buzzer, the setting state can be confirmed easily even if the video printer is placed in a hardly visible manner.

Meanwhile, when printing is to be made by the thermal head, the number of sheets that can be printed continuously is usually limited to a certain value, for example, 40, because of heat accumulation in the thermal head. In the embodiment illustrated, an upper limit, such as 10, is previously set in the number of times of printing, or a limitation is put on the time of accepting an input at the copy key 2*b*. If, in such case, a number of times of printing larger than the upper limit as preset on the video printer, or if the entry accept time has elapsed, such effect may be apprised of the user by producing a modified buzzer is produced or not producing the buzzer sound.

Besides, with the present video printer, the printing operation may be discontinued by an ON operation of the stop key. However, with the video printer shown in FIG. 24, the opening key 90 for opening the sheet housing section 10 is used simultaneously as the above-mentioned stop key. That is, since the sheet housing section 90 usually is not opened during the printing operation, the opening key 90 may be used simultaneously as the stop key without any inconveniences, while there is no necessity of providing a new stop key.

What is claimed is:

1. A video printer comprising:

a chassis, a platen rotatably mounted on said chassis, a printing head operatively supported on said chassis so as to be movable between a pressure-contacted position in which the printing head is pressure-contacted with said platen and a standby position in which said printing head is spaced apart from said platen, a roll for pressure-contacting a transfer sheet against said platen, said transfer sheet being guided by a sheet guide system through a space between said platen and said printing head to a sheet exit opening, a cutter provided at a position spaced from said printing head by a predetermined distance and proximate said sheet exit opening, means for moving said printing head to said pressure-contact position when said printer is pringing and to said standby position when said printer is not printing, and means for, when printing an image on said transfer sheet, rewinding said transfer sheet by a distance less than the predetermined distance between said printing head and said cutter.

2. The video printer as defined in claim 1, wherein said rewinding means comprises: an FG pulse generator for generating FG pulses in accordance with the rotation of said platen, and means for counting said FG pulses generated by said FG pulse generator and for detecting a rewind amount of said transfer sheet when printing of said image on said transfer sheet.

3. The video printer as defined in claim 2 further comprising a photosensor provided between said cutter and the printing head for detecting a presence of said transfer sheet, and wherein said rewinding means discontinues the rewinding of the transfer sheet are no FG pulses being generated by said FG pulse generator and/or when said transfer sheet is detected as being absent by said photosensor.

4. The video printer as defined in claim 2 wherein said FG pulse generator comprises:

an FG fin provided on a main shaft of said platen said FG fin having plural slits in its outer periphery, said slits being of a constant width and arrayed radially at a constant pitch, and a photo-interrupter having a light emitter and a light receiver, said light emitter and the light receiver being positioned on either sides of the outer periphery of said FG fin provided with said slits.

5. A video printer comprising:

a chassis, a platen rotatably mounted on said chassis, a printing head operatively supported on said chassis so as to be movable between a pressure-contact position in which the printing head is pressure-contacted with said platen and a standby position in which said printing head is spaced apart from said platen, a roll for pressure-contacting a transfer sheet against said platen, said transfer sheet being guided by a sheet guide system through a space between said platen and said printing head to a sheet exit opening, a cutter provided at a position spaced apart from said printing head by a predetermined distance and proximate to said sheet exit opening, means for moving said printing head to said pressure-contact position when said printer is printing and to said standby position when said printer is not printing, and changeover means, including means for feeding and rewinding said transfer sheet, for changing a feed quantity of said transfer sheet between printing units in plural stages when printing said image a plural number of times on said transfer sheet.

6. The video printer as defined in claim 5 further comprising controlling means for controlling the feed quantity of said transfer sheet between said printing units responsive to a changeover signal from said changeover means.

7. The video printer as defined in claim 5 wherein a feed quantity of said transfer sheet between said printing units, as changed by said changeover means, includes at least a minimum discernible distance between said printing units.

8. The video printer as defined in claim 4 further comprising:

an FG pulse generator for generating FG pulses in accordance with rotation of said platen, and means for counting said FG pulses generated by said FG pulse counter and for detecting a rewind amount of said transfer sheet when printing an image on said transfer sheet.

9. The video printer as defined in claim 8 wherein said FG pulse generator comprises:

an FG fin provided on a main shaft of said platen said FG fin having plural slits in its outer periphery, said slits being of a constant width and arrayed radially at a constant pitch, and a photo-interrupter having a light emitter and a light receiver, said light emitter and the light receiver being positioned on either sides of the outer periphery of said FG fin provided with said slits.

* * * * *